US011499796B2

(12) United States Patent
Martini

(10) Patent No.: US 11,499,796 B2
(45) Date of Patent: Nov. 15, 2022

(54) FIREARM EQUIPMENT AND ACCESSORIES

(71) Applicant: Elite Illyrian, Corp., Grosse Pointe, MI (US)

(72) Inventor: Ilir Martini, Grosse Pointe, MI (US)

(73) Assignee: Elite Illyrian, Corp., Grosse Pointe, MI (US)

( * ) Notice: Subject to any disclaimer, the term of this patent is extended or adjusted under 35 U.S.C. 154(b) by 0 days.

(21) Appl. No.: 16/783,024

(22) Filed: Feb. 5, 2020

(65) Prior Publication Data

US 2020/0256636 A1 Aug. 13, 2020

Related U.S. Application Data

(60) Provisional application No. 62/803,872, filed on Feb. 11, 2019.

(51) Int. Cl.

| | |
|---|---|
| ***F41C 23/16*** | (2006.01) |
| ***F41A 35/02*** | (2006.01) |
| ***F41A 21/48*** | (2006.01) |
| ***F41A 3/66*** | (2006.01) |

(52) U.S. Cl.

CPC ..... *F41C 23/16* (2013.01); *F41A 3/66* (2013.01); *F41A 21/48* (2013.01); *F41A 35/02* (2013.01)

(58) Field of Classification Search

CPC .. F41C 23/16; F41A 3/66; F41A 21/48; F41A 21/481; F41A 21/482; F41A 21/484; F41A 21/485; F41A 21/487; F41A 21/488; F41A 35/02

USPC ..... 42/18, 71.01, 75.02

See application file for complete search history.

(56) References Cited

U.S. PATENT DOCUMENTS

| | | | | |
|---|---|---|---|---|
| 4,454,798 | A | 6/1984 | Shea et al. | |
| 5,918,401 | A | 7/1999 | Rowlands | |
| 6,298,764 | B1 | 10/2001 | Sherman et al. | |
| 6,671,990 | B1 * | 1/2004 | Booth | F41C 23/16 42/75.01 |
| 6,796,214 | B2 | 9/2004 | Hausken et al. | |
| 8,156,854 | B2 | 4/2012 | Brown | |
| 8,196,701 | B1 | 6/2012 | Oliver | |
| 8,806,792 | B2 | 8/2014 | Yan et al. | |
| 8,807,005 | B2 | 8/2014 | Moss et al. | |
| 8,899,138 | B2 | 12/2014 | Brown | |
| 9,546,838 | B2 | 1/2017 | Liskey et al. | |
| 2010/0319231 | A1 * | 12/2010 | Stone | F41C 23/00 42/71.01 |
| 2011/0000119 | A1 * | 1/2011 | DeSomma | F41G 11/003 42/75.02 |

(Continued)

OTHER PUBLICATIONS

POF USA, Complete Uppers product pages. Aug. 28, 2018.

*Primary Examiner* — Bret Hayes
(74) *Attorney, Agent, or Firm* — Burris Law, PLLC

(57) ABSTRACT

A combined firearm receiver and rail includes a handguard rail and a receiver housing disposed within the handguard rail. The handguard rail includes one of a takedown lug clearance slot, a handguard magazine port, a handguard continuous rail, a handguard ejection port, an attachment location, accessory attachment points, a handguard charging handle latch retaining slot, a charging handle housing, a charging handle guideway, a bolt catch clearance slot, a barrel cavity, a receiver cavity, an exhaust port, and a handguard section. In one variation, the handguard section does not come into physical contact with a barrel or a barrel nut of the firearm.

21 Claims, 27 Drawing Sheets

(56) References Cited

U.S. PATENT DOCUMENTS

| | | | | |
|---|---|---|---|---|
| 2011/0016762 | A1* | 1/2011 | Davies | F41A 21/487 42/75.01 |
| 2016/0033219 | A1* | 2/2016 | Meier | F41C 23/20 89/191.01 |
| 2016/0209166 | A1* | 7/2016 | Larson, Jr. | F41G 1/033 |
| 2018/0259276 | A1* | 9/2018 | Doll | F41A 21/482 |

* cited by examiner

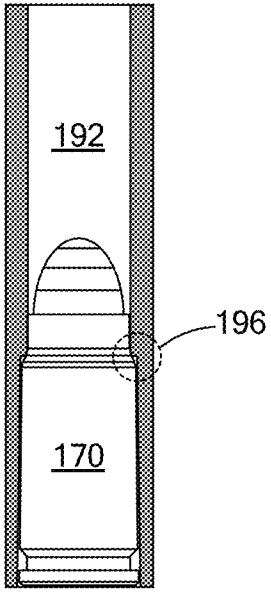
FIG. 8E
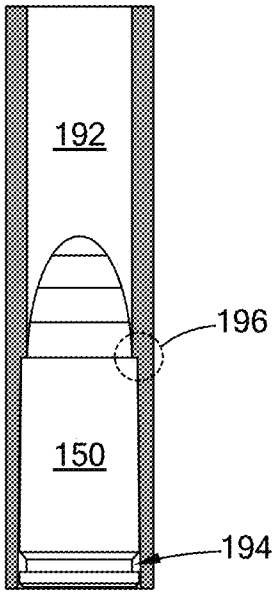
FIG. 8F
FIG. 8G
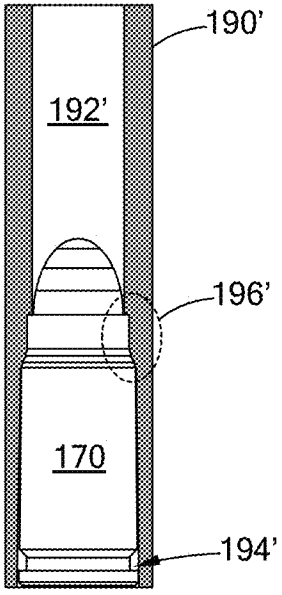
FIG. 8H

FIREARM EQUIPMENT AND ACCESSORIES

CROSS-REFERENCE TO RELATED APPLICATIONS

This application claims priority to and the benefit of U.S. Provisional Patent Application No. 62/803,872, filed on Feb. 11, 2019. The disclosure of the above application is incorporated herein by reference.

FIELD

The present disclosure relates to firearms and various accessories that improve the performance and operation of such firearms.

BACKGROUND

The statements in this section merely provide background information related to the present disclosure and may not constitute prior art.

Rail systems are strips of metal or plastic attached to a firearm to allow the ready attachment of various accessories, such as scopes, lights, hand grips, among others. Often the rail system interferes with the ejection of spent cartridges. This ejection interference may be caused by installation errors or design deficiencies. Ejection interference can cause many issues including malfunction of the firearm and cartridge impacts to the operator.

Customized ammunition generally involves a customized cartridge size or a customized projectile diameter. One issue with custom ammunition is that the ammunition is difficult to acquire because the ammunition is not mass-produced. The lack of mass-produced ammunition increases the cost of the ammunition and reduces the ability to sell the firearm that uses the ammunition.

During normal operation of a firearm (e.g. firearm discharge), significant amounts of flash (light), heat, noise (acoustics), and pollutants (e.g. spent gunpowder) are produced. It is desirable to reduce the flash, heat, and noise to improve the concealment of the firearm operator. Various sound reducing devices are employed to reduce noise levels. Unfortunately, these devices often increase the firearm barrel temperature, decrease shot accuracy, increase firearm weight, increase firearm blowback, increase manufacturing complexity, alter firearm recoil behavior, increase the time between successive shots on target.

The present disclosure addresses the issues of ejection interference, mass production of customized ammunition, firearm discharge, among other issues related firearm operation.

SUMMARY

This section provides a general summary of the disclosure and is not a comprehensive disclosure of its full scope or all of its features.

In one form of the present disclosure, a combined firearm receiver and rail is provided. The combined firearm receiver and rail comprises a handguard rail and a receiver housing disposed within the handguard rail. The handguard rail comprises at least one of a takedown lug clearance slot, a handguard magazine port, a handguard continuous rail, a handguard ejection port, an attachment location, accessory attachment points, a handguard charging handle latch retaining slot, a charging handle housing, a charging handle guideway, a bolt catch clearance slot, a barrel cavity, a receiver cavity, an exhaust port, and a handguard section. Where the handguard section does not come into physical contact with a barrel or a barrel nut of a firearm. While the receiver housing comprises at least one of a gas key clearance slot, a cam pin clearance cut-out, an ejection port, a fastening location, a gas line housing, a gas line, barrel receiver, a trunnion pin slot, a magazine port, a fire control group opening, a takedown lug, a takedown lug pin hole, a shell deflector, a gas key slot opening, a trunnion port, and combinations thereof. The shell deflector does not protrude away from an exterior surface of the receiver housing. When combined, the cross-sectional thickness of the handguard rail and the receiver housing is such that the receiver housing does not protrude through the handguard rail.

In another combined firearm receiver and rail of the present disclosure, the receiver housing further comprises an integral barrel trunnion.

Alternatively, the combined firearm receiver and rail of the present disclosure, further comprises a dust cover secured to either the handguard rail or the receiver housing.

In other forms of the combined firearm receiver and rail of the present disclosure, the handguard rail is mechanically secured to the receiver housing. The mechanical securing is one of a screw, a bolt, a quick detach latch, a clasp, a spring-loaded button, a press-fit, and combinations thereof.

In yet another combined firearm receiver and rail of the present disclosure, a rear portion of at least one of the handguard rail and the receiver housing defines a slotted octagonal cross-sectional area.

In variations of the combined firearm receiver and rail of the present disclosure, at least one of the handguard rail and the receiver housing are a magnesium or a polymeric material.

In at least one of the combined firearm receiver and rail of the present disclosure, at least one of the handguard rail and the receiver housing is manufactured by a method selected from the group consisting of extrusion, investment casting, injection molding, machining, and additive manufacturing.

In numerous of the combined firearm receiver and rails of the present disclosure, the handguard section extends from a rear portion of the handguard rail to an area over a barrel of the firearm.

In another combined firearm receiver and rail of the present disclosure, the handguard continuous rail is a continuous picatinny rail. In some combined firearm receiver and rails of the present disclosure, the receiver housing comprises an integral shell deflector, and a combined cross-sectional thickness of the handguard rail and the receiver housing is such that the integral shell deflector of the receiver housing does not protrude away from an exterior surface of the receiver housing.

In another form of the present disclosure a combined firearm receiver and rail is provided. The combined firearm receiver and rail comprises a handguard rail and a receiver housing disposed within the handguard rail. The handguard rail comprises a takedown lug clearance slot, a handguard magazine port, a handguard continuous rail, a handguard ejection port, an attachment location, accessory attachment points, a handguard charging handle latch retaining slot, a charging handle housing, a charging handle guideway, a bolt catch clearance slot, a barrel cavity, a receiver cavity, a shell deflector, an exhaust port, a handguard section, and an integral shell deflector. The receiver housing comprises a gas key clearance slot, a cam pin clearance cut-out, an ejection port, a fastening location, a gas line housing, a gas line, barrel receiver, a trunnion pin slot, a magazine port, a fire control group opening, a takedown lug, a takedown lug pin hole, a gas key slot opening, and a trunnion port. A rear portion of at least one of the handguard rail and the receiver housing defines a slotted octagonal cross-sectional area. The handguard section does not come into physical contact with a barrel or a barrel nut of the firearm and the handguard section extends from the rear portion of the handguard rail to an area over a barrel of the firearm. While a combined cross-sectional thickness of the handguard rail and the receiver housing is such that the receiver housing does not protrude through the handguard rail and the combined cross-sectional thickness of the handguard rail and the receiver housing is such that the integral shell deflector of the receiver housing does not protrude away from an exterior surface of the receiver housing. additionally, the handguard rail is removably and mechanically secured to the receiver housing.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 8E is a cross-sectional side view of a commercially available firearm barrel;

FIG. 8F is a view of the firearm barrel of FIG. 8E with the commercially available firearm cartridge of FIG. 7A;

FIG. 8G is a view of the firearm barrel of FIG. 8E with the shouldered cartridge of FIG. 8A, according to the teachings of the present disclosure;

FIG. 8H is a cross-sectional side view and illustrates an exemplary firearm barrel with the shouldered cartridge of FIG. 8A, according to the teachings of the present disclosure;

Figure 1A:
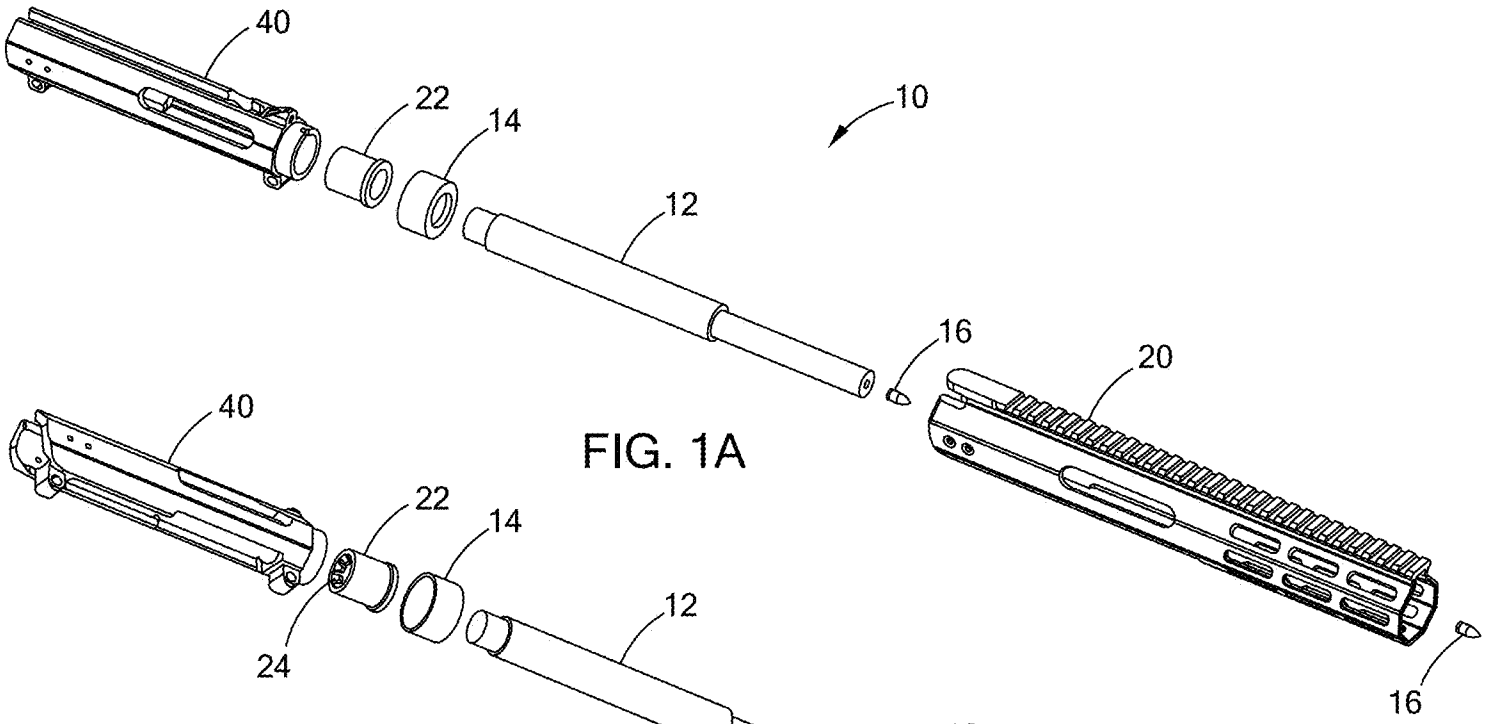
FIG. 1A is an exploded perspective top view and illustrates an exemplary combined firearm receiver and rail, according to the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Firearm Receiver/Handguard Rail

Figure 1B:
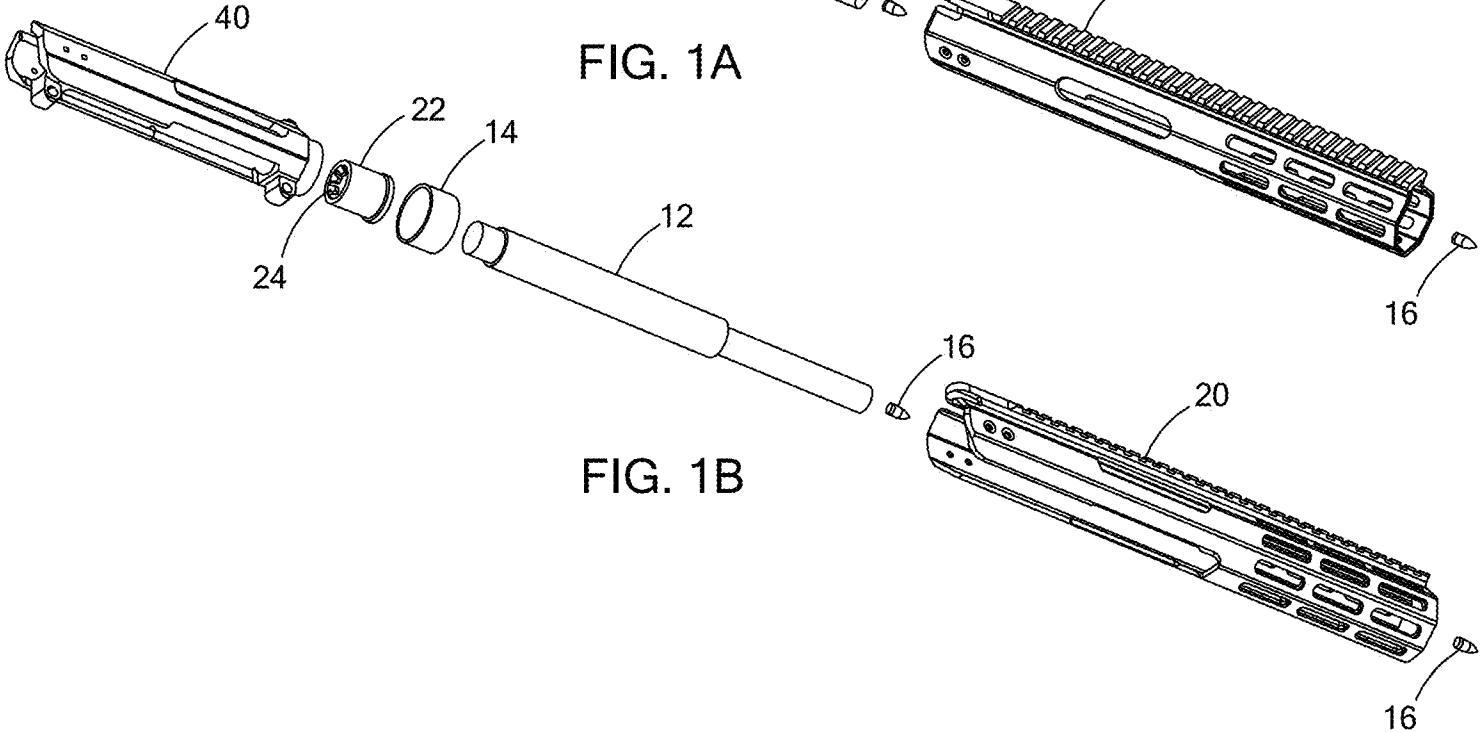
FIG. 1B is an exploded perspective bottom view of the combined firearm receiver and rail of FIG. 1A, according to the teachings of the present disclosure.

Referring to FIGS. 1A and 1B, in one form of the present disclosure, a combined firearm receiver and rail 10 is provided. The combined firearm receiver and rail 10 comprises a barrel 12, a barrel nut 14, a handguard rail 20, a trunnion 22, and a receiver housing 40. The receiver housing 40 is disposed within and coupled to the handguard rail 20. The receiver housing 40, trunnion 22, barrel 12, barrel nut 14, handguard rail 20 are coaxially aligned and configured to allow a projectile 16 to exit a firearm (not shown).

The barrel 12 is coupled to the trunnion 22 which is coupled to the receiver housing 40, while the barrel nut 14 is slidably coupled over the barrel 12 to align, couple, and secure the barrel 12, trunnion 22, and receiver housing 40 together.

The trunnion 22 includes trunnion lugs 24 that couple the trunnion to the bolt lugs (not shown, refer to definitions below). The inner diameter of the trunnion 22 is configured to couple to the barrel 12, common coupling techniques include bolts, pins, press-fits, quick detach latches, screws, shrink-fits, spring-loaded buttons, threads, among others.

Receiver Housing

Now referring to FIGS. 2A through 2F, the receiver housing 40 comprises at least one of a gas key clearance slot 42, a cam pin clearance cut-out 44, an ejection port 46, a fastening location 48, a gas line housing 50, a gas line 52, barrel receiver 54, a trunnion pin slot 56, a magazine port 58, a fire control group opening 60, a takedown lug 62, a takedown lug pin hole 64, a gas key slot opening 66, and a trunnion port 68. Receiver housings are often forged or machined and contain (i.e. house) internal components such as the hammer, bolt or breechblock, action and firing mechanism. Receiver housings are often configured to "receive" the barrel and the stock and/or grip (handgrip).

Referring now to FIGS. 2G through 2L, the gas key clearance slot 42 and cam pin clearance cut-out 44 receive the gas key (not shown) of the firearm, the gas key is part of the firearm action (not shown). The firearm action is the mechanism that handles (loads, locks, fires, extracts, ejects, among others) the ammunition. The gas key slides over the gas line 52 creating a chamber to operate the bolt when the gas line is pressurized enabling the firearm action. As shown in this form, gas key clearance slot 42 is continuous in the upper portion of the receiver housing 40. Gas key clearance slot 42 is a blind slot that ends at the gas line housing 50 and is open distal from the gas line housing 50 in the gas key slot opening 66. The fastening location 48 enables mounting of the receiver housing 40 to the handguard rail 20.

The magazine port 58 and fire control group opening 60 are where the firearm magazine and fire control group opening are respectively coupled to the receiver housing 40. The takedown lug(s) 62 enable coupling the receiver housing 40 to a lower receiver (not shown).

The firearm action expels spent casings out of the ejection port 46. Improper ejection increases malfunctions of the firearm.

The gas line housing 50 may be polygonal or ovoid in cross-section, depending on the desired gas release rate and malfunction rates of the firearm as inadequate gas release rates may foul the firearm action.

Note the gas line housing 50 and gas line 52 couple and/or slidably couple to the gas tube (not shown) that transports the gas back through the gas line 52. The gas tube is coupled to the barrel gas block (not shown) which is coupled to the barrel 12 in line with the barrel gas port (not shown).

The barrel receiver 54 couples the receiver housing 40 to the barrel 12. In some forms, of the present disclosure the barrel receiver 54 is threaded or otherwise enabled to couple to the barrel nut 14. The barrel nut 14 simultaneously aligns and couples the barrel 12 to the receiver housing 40.

The trunnion 22 couples to the receiver housing 40 at the barrel receiver 54 within the trunnion port 68. The trunnion pin slot 56 aligns the trunnion 22 to the receiver housing 40. The trunnion 22 and the barrel receiver 54 align and couple the barrel 12 to the receiver housing 40. Further, the trunnion pin slot 56 aligns the barrel gas port (not shown) to the gas line housing 50 and the gas line 52.

Figure 2A:
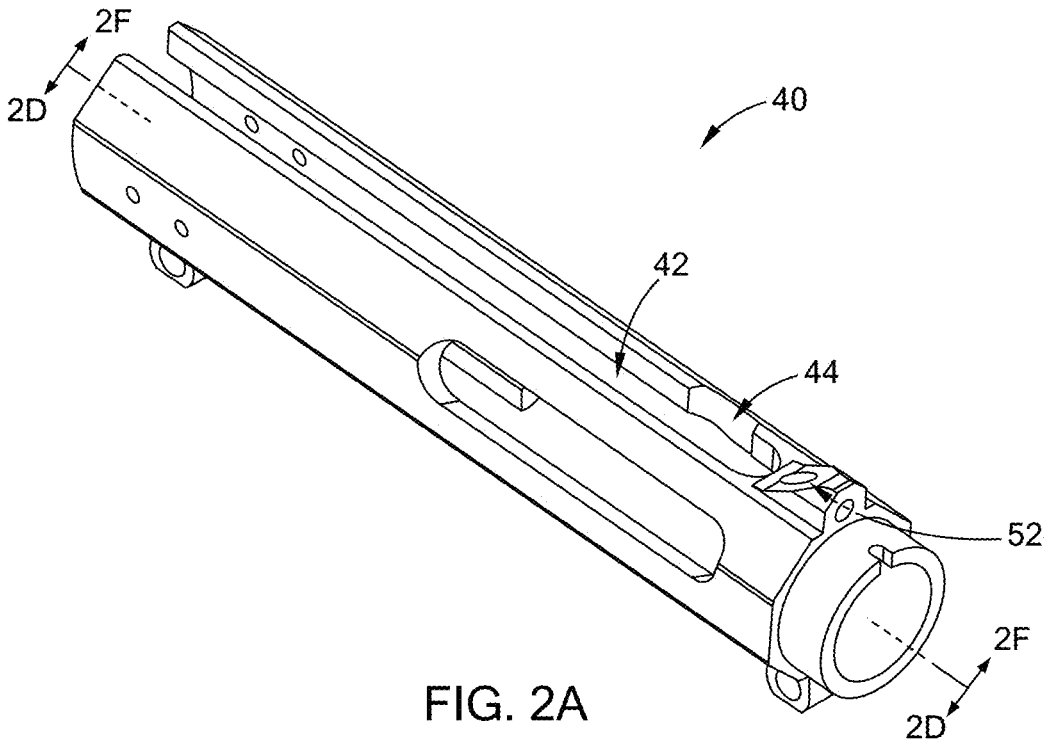
FIG. 2A is a perspective top view and illustrates an exemplary receiver housing, according to the teachings of the present disclosure.
Figure 2B:
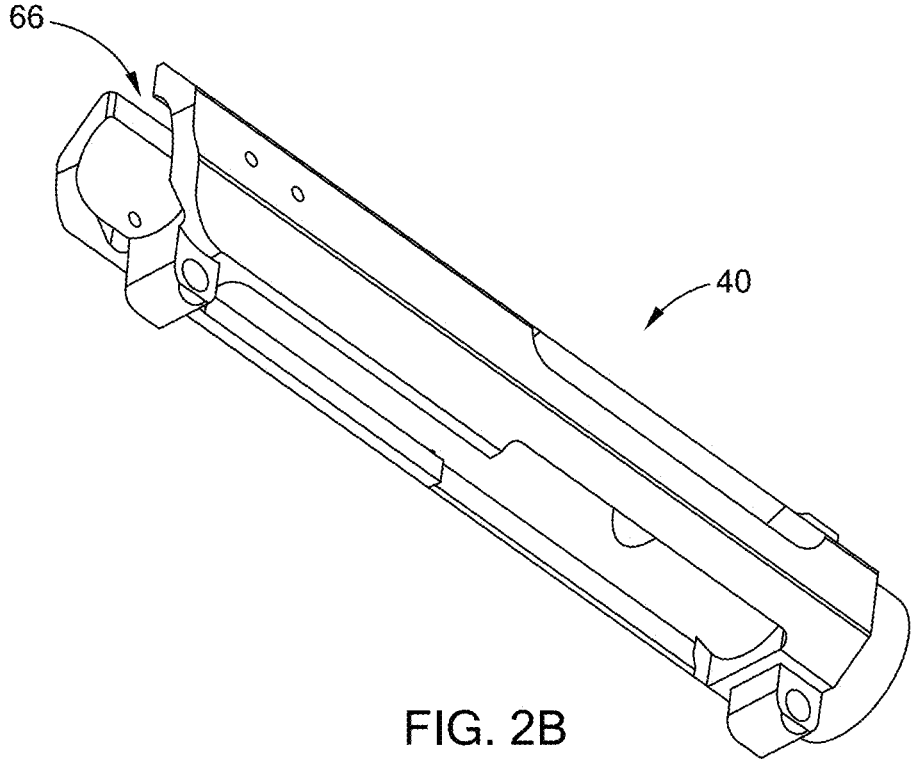
FIG. 2B is a perspective bottom view of the receiver housing of FIG. 2A, according to the teachings of the present disclosure.
Figure 2C:
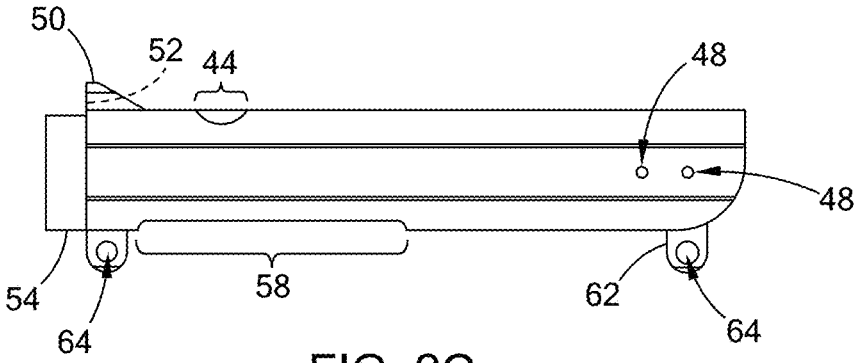
FIG. 2C is a left-side view of the receiver housing of FIG. 2A, according to the teachings of the present disclosure.
Figure 2D:
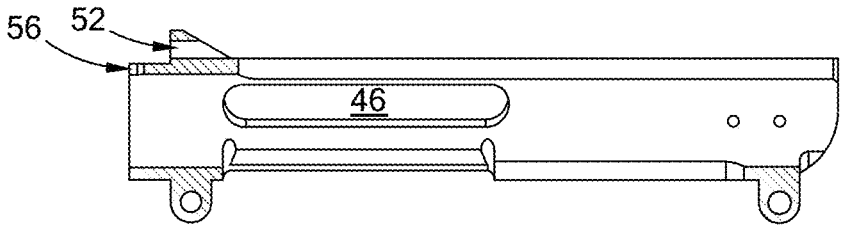
FIG. 2D is a cross-sectional view, taken along line 2D-2D of FIG. 2A, of the receiver housing according to the teachings of the present disclosure.
Figure 2E:
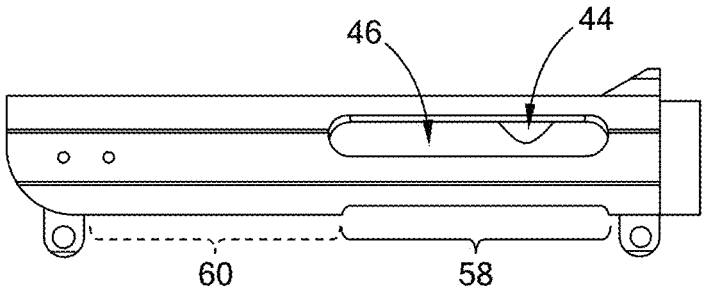
FIG. 2E is a right-side view of the receiver housing of FIG. 2A, according to the teachings of the present disclosure.
Figure 2F:
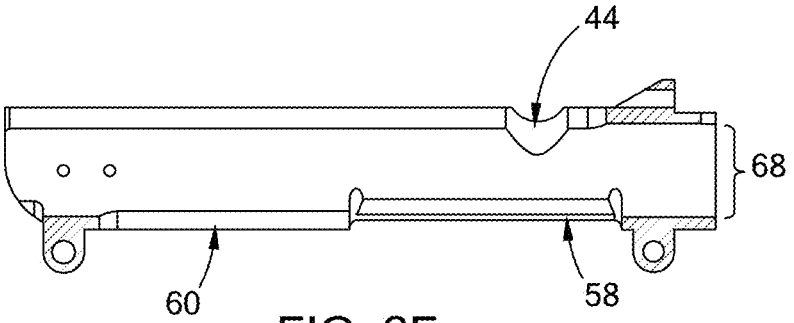
FIG. 2F is a cross-sectional view, taken along line 2F-2F of FIG. 2A, of the receiver housing, according to the teachings of the present disclosure.
Figure 2G:
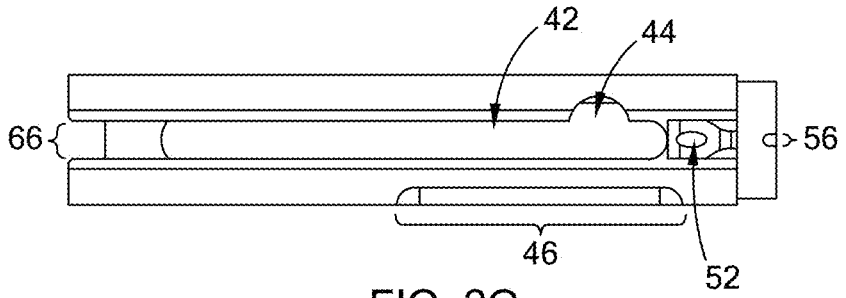
FIG. 2G is a top view of the receiver housing of FIG. 2A, according to the teachings of the present disclosure.
Figure 2H:
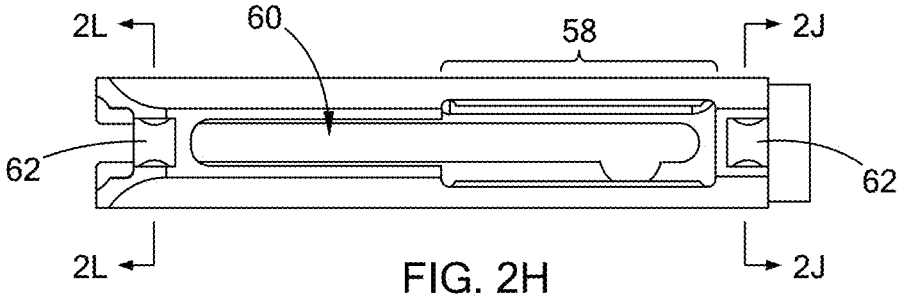
FIG. 2H is a bottom view of the receiver housing of FIG. 2A, according to the teachings of the present disclosure.
Figure 2I:
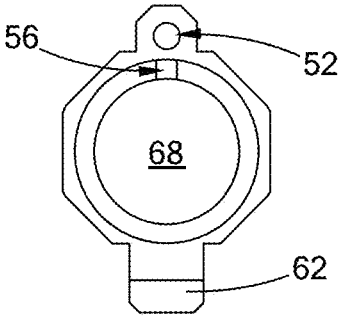
FIG. 2I is a front view of the receiver housing of FIG. 2A, according to the teachings of the present disclosure.
Figure 2J:
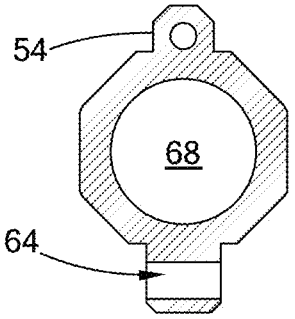
FIG. 2J is a cross-sectional view, taken along line 2J-2J of FIG. 2H, of the receiver housing according to the teachings of the present disclosure.
Figure 2K:
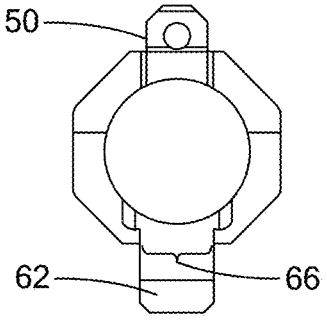
FIG. 2K is a rear view of the receiver housing of FIG. 2A, according to the teachings of the present disclosure.
Figure 2L:
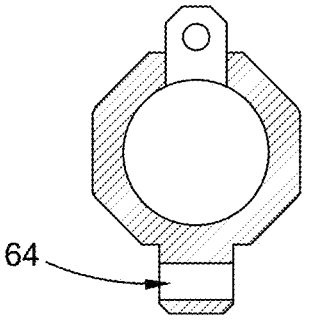
FIG. 2L is a cross-sectional view, taken along line 2L-2L of FIG. 2H, of the receiver housing, according to the teachings of the present disclosure.
Figure 2M:
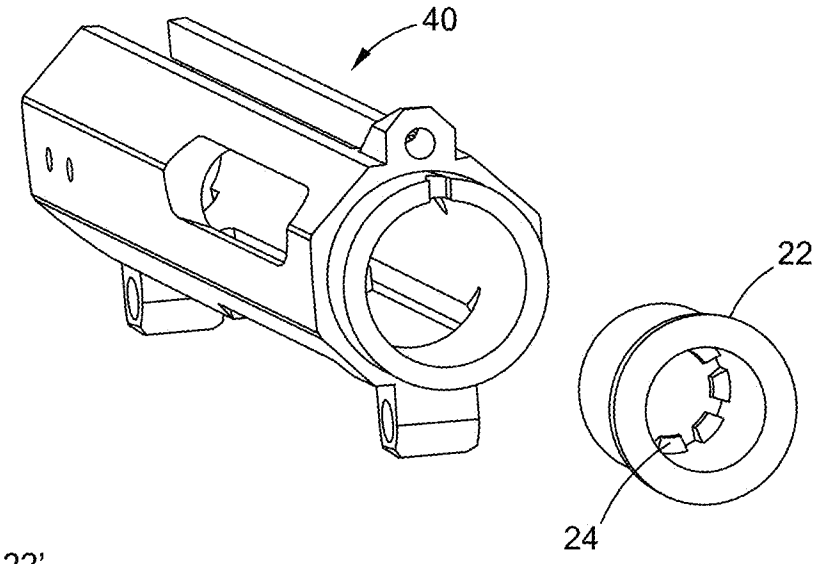
FIG. 2M is a perspective side view of the receiver housing of FIG. 2A and a trunnion, according to the teachings of the present disclosure.
Figure 2N:
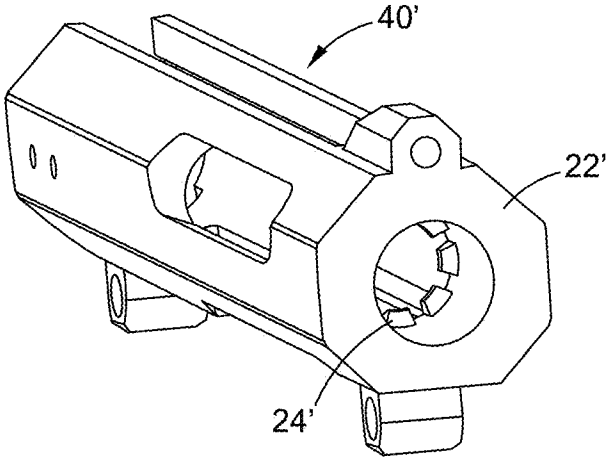
FIG. 2N is a perspective side view of an exemplary receiver housing with an integral trunnion, according to the teachings of the present disclosure.

Referring now to FIGS. 2M, the 1A, 1B, and 2M, the trunnion 22 and receiver housing 40 of FIGS. 1A and 1B are shown, to improve the comparison of FIG. 2M and FIG. 2N.

Figures 2O, 2P:
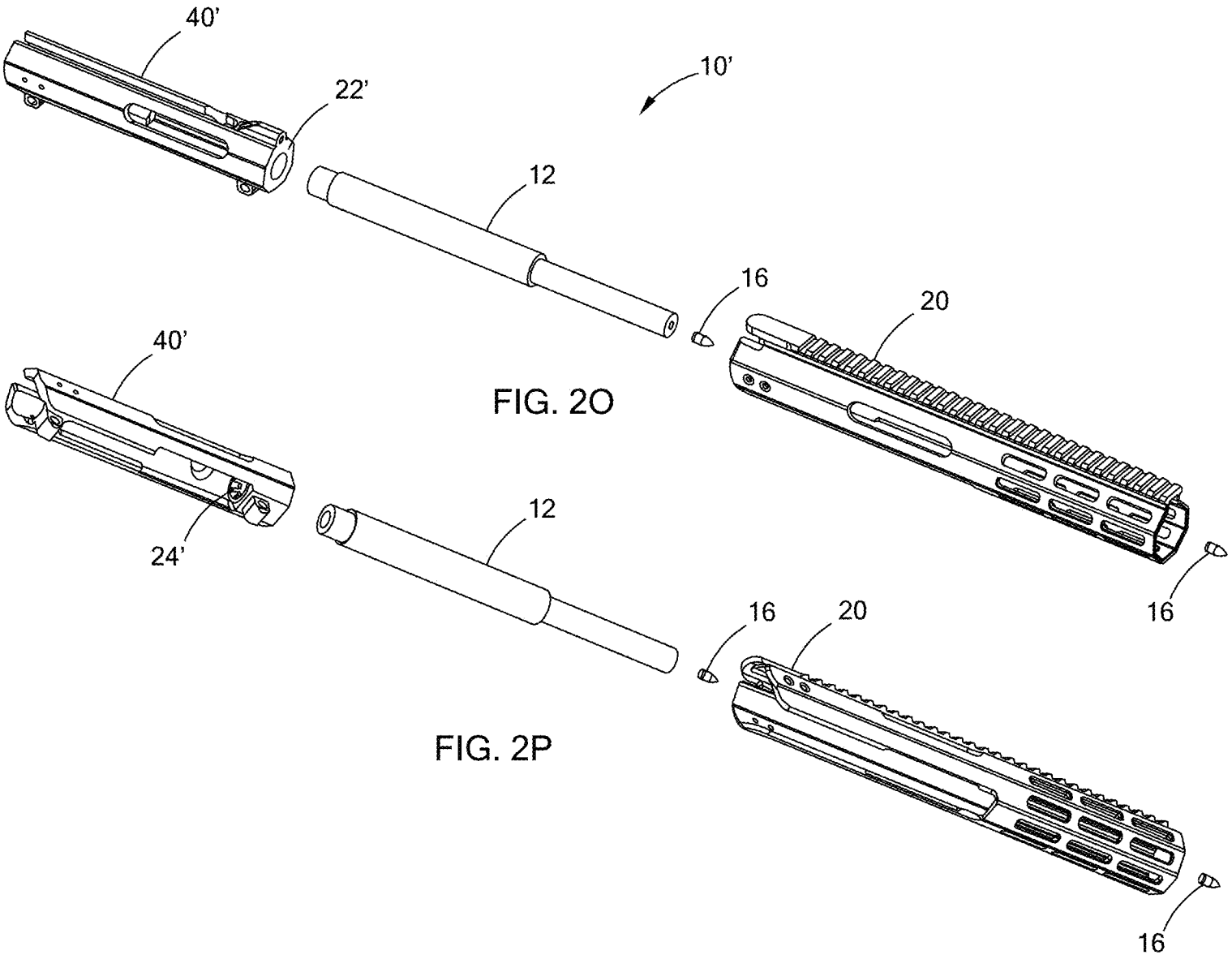
FIG. 2O is an exploded perspective top view and illustrates an exemplary combined firearm receiver and rail with the receiver housing of FIG. 2N, according to the teachings of the present disclosure.
FIG. 2P is an exploded perspective bottom view of the combined firearm receiver and rail of FIG. 2N, according to the teachings of the present disclosure.

Referring to FIG. 2N, the trunnion 22' is integral to the receiver housing 40' in one form of the present disclosure, rather than being a separate component. The integration of the trunnion 22' into the receiver housing 40' improves firearm efficiency by reducing complexity, expense, geometrical stack up, logistics, maintenance, malfunctions, and weight while improving accuracy, durability, and strength. In FIGS. 2O and 2P a combined firearm receiver and rail 10' comprises the barrel 12, the handguard rail 20, the trunnion 22', and the receiver housing 40'.

Handguard Rail

Referring to FIGS. 3A through 3F, the handguard rail 20 comprises at least one of a takedown lug clearance slot 80, a handguard magazine port 82, a handguard section 83, a handguard continuous rail 84, a handguard ejection port 86, attachment holes 88, accessory attachment apertures 90, a handguard charging handle latch retaining slot 92, a charging handle housing 94, a charging handle guideway 96, a barrel cavity 100, a receiver cavity 102, and an exhaust port 104. Generally, rail systems enable the attachment of numerous firearm accessories (e.g. ammunition, electronics, grips, lights, magazines, mounts, optics, scopes, sights, slings, among others) to firearms. Rails enable various firearm operator desires, including by way of example: improving the ease at which firearm accessories may be mounted and dismounted from the firearm; uniformity in placement on the same or different firearms; and improve alignment of firearm or operator accessories, components, and/or equipment. The amount of rail space allows adjustment and operator optimization of each device and tool attached for the operator.

Referring now to FIGS. 3G through 3L, the takedown lug clearance slot 80 is adjacent to and in some forms overlaps the handguard magazine port 82. The takedown lug clearance slot 80 couples or slidably couples the handguard rail 20 to the receiver housing 40. The takedown lug clearance slot and handguard magazine port 82 are unique features of the present disclosure, as most rails connect in series with the receiver instead of slidably coupling over the receiver. This coupling concurrently aligns the takedown lug clearance slot 80 and the receiver housing 40. The attachment holes 88 aligns with fastening location 48 enabling mounting of the receiver housing 40 to the handguard rail 20.

The handguard charging handle latch retaining slot 92 couples to the charging handle inhibiting the charging handle from dislodging during operation, which could cause malfunction. Usually, retention of the charging handle is on the firearm receiver and not the rail system, placing the charging handle on the handguard rail is an advantageous form of the present disclosure.

In some forms the handguard charging handle latch retaining slot 92 is a through hole and in other forms the handguard charging handle latch retaining slot 92 is a blind hole.

The charging handle housing 94 cradles the charging handle and keeps it from obstructing, a bolt carrier (not shown) aligning the charging handle latch with the handguard charging handle latch retaining slot 92.

The handguard continuous rail 84 is a marked improvement over conventional (i.e. segmented) rail systems for several reasons including improved: alignment of accessories to other accessories; alignment of accessories to the firearm; alignment with firearm; alignment of the firearm to vehicle mounted systems; impact resistance; maintenance; rigidity; overall strength; thermal stability; torque resistance; and combinations thereof. Further, as compared to conventional rail systems, the handguard continuous rail 84 reduces: accessory to accessory alignment time; accessory to firearm alignment time; complexity; maintenance; risk of malfunctions; weight; and combinations thereof.

In some forms, there is a supplementary handguard continuous rail (not shown) that is not located on the top of the handguard rail 20.

The accessory attachment apertures 90 are located at any reasonable location upon the handguard rail 20 that the operator desires. Further, the accessory attachment apertures 90 enable at least one of ventilation and cooling for the barrel 12; flash hider; improves time on target; and improves operator fire control.

The charging handle guideway 96 aligns, couples, and slidably couples the charging handle (not shown) with the handguard rail 20. The charging handle guideway 96 improves a several aspects of the combined firearm receiver and rail 10, including maintenance; wear of the charging handle; time to clear a malfunction. Further, the charging handle guideway 96 enables firearm exhaust to exit the handguard rail 20. In one advantageous form of the present disclosure, the charging handle guideway 96 extends the length of the handguard rail 20, while conventional rails only extend forward of the trunnion or barrel receiver and are incapable of including a charging handle guideway.

The handguard ejection port 86 enables casings, shells, or shell casings ejected through the ejection port 46 to exit the handguard rail 20 and reduce malfunctioning (jamming) of the firearm action. This surprising feature of the present disclosure is not available on handguard rails known to the developers; as ejection ports are solely on the firearm receiver and not the rail.

The barrel cavity 100 slidably couples over the barrel 12 of the firearm. The receiver cavity 102 slidably couples over the receiver housing 40. Because the barrel 12 often partially couples within the receiver housing 40, the barrel cavity 100 and receiver cavity 102 often overlap. The exhaust port 104 enables firearm exhaust to exit the handguard rail 20 forward of the action; the firearm exhaust egressing through the exhaust port 104 passes the gas line housing 50 as the firearm exhaust gas egresses the firearm. In another advantageous form of the present disclosure, the exhaust port 104 is configured on the handguard rail 20 allowing exhaust gases to egress both forward and backward of the action, while conventional rails only extend forward of the trunnion or barrel receiver and are incapable of allowing exhaust gas egress backward of the action. Further, because conventional exhaust ports are configured on the firearm receiver, exhaust port 104 is different over known systems because the exhaust port 104 runs the length of the handguard rail 20 and the receiver housing 40 (i.e. the combined firearm receiver and rail 10)

Figure 3A:
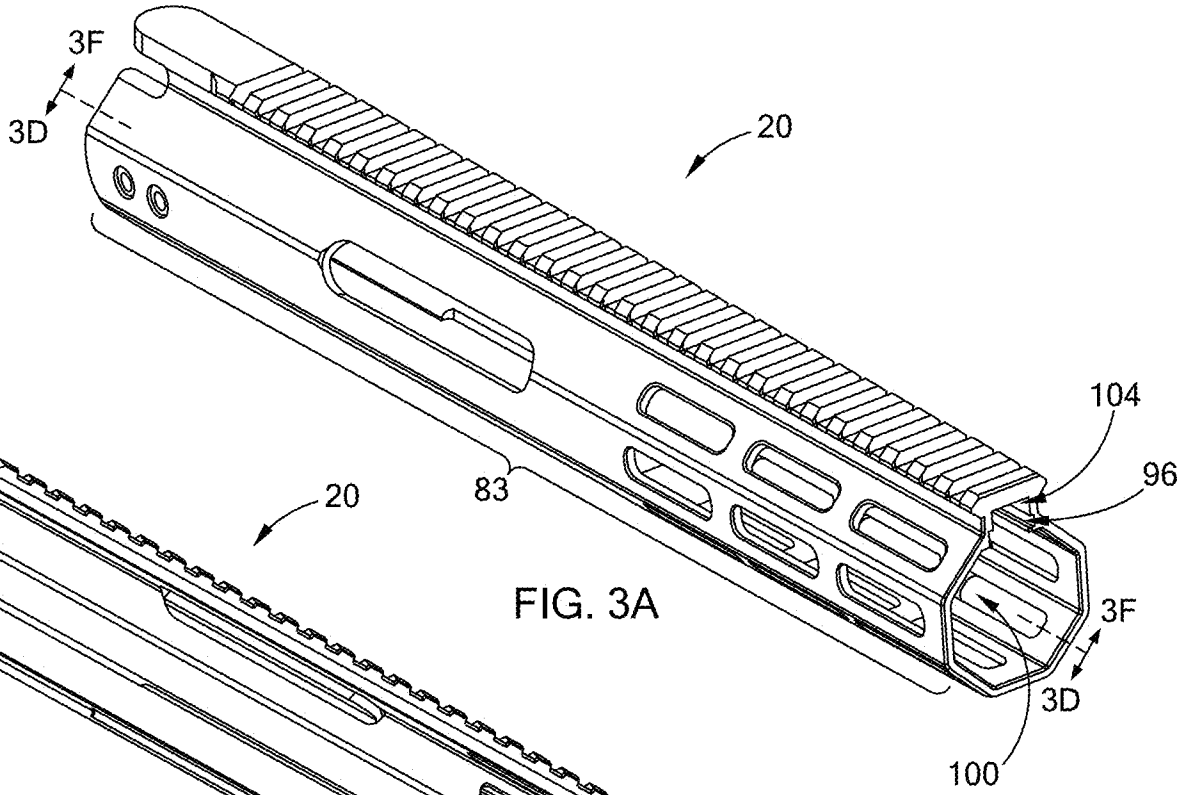
FIG. 3A is a perspective top view and illustrates an exemplary handguard rail, according to the teachings of the present disclosure, according to the teachings of the present disclosure.
Figure 3B:
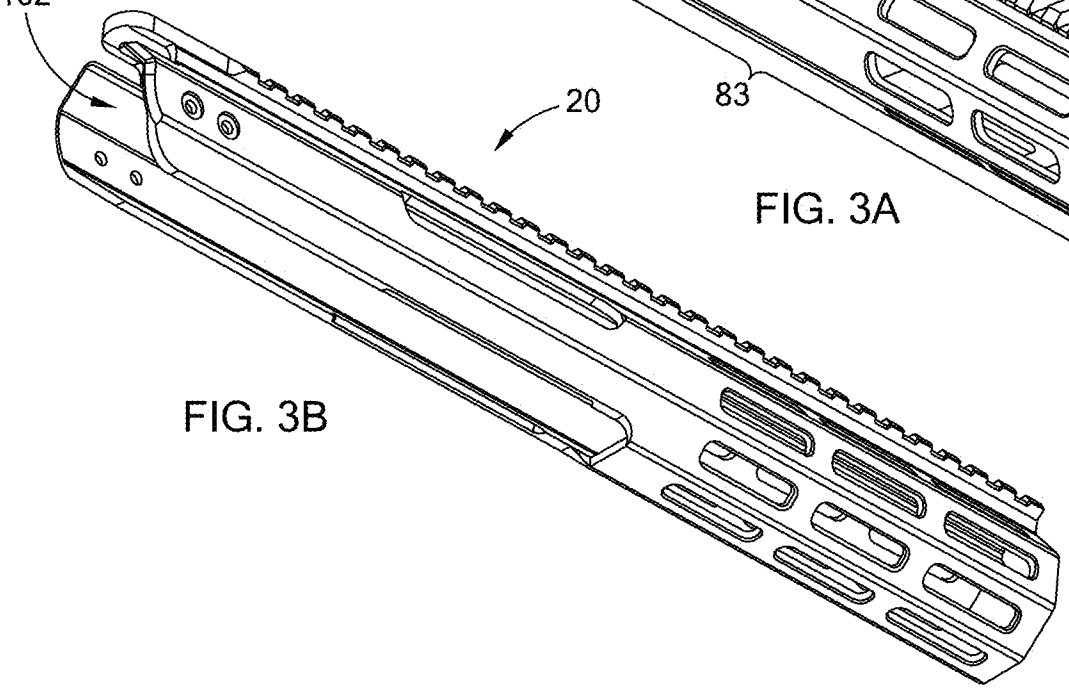
FIG. 3B is a perspective bottom view of the handguard rail of FIG. 3A, according to the teachings of the present disclosure.
Figure 3C:
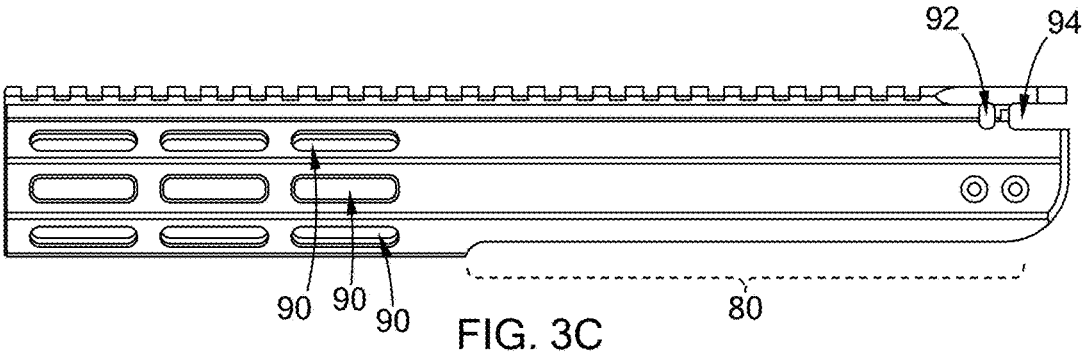
FIG. 3C is a left-side view of the handguard rail of FIG. 3A, according to the teachings of the present disclosure.
Figure 3D:
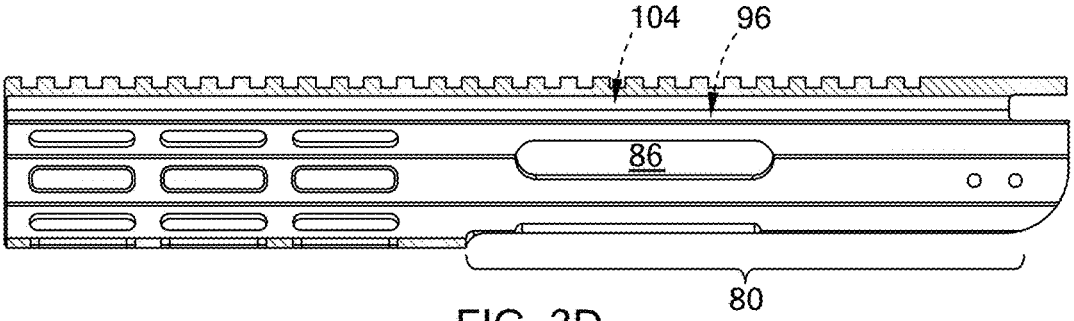
FIG. 3D is a cross-sectional view, taken along line 3D-3D of FIG. 3A, of the handguard rail, according to the teachings of the present disclosure.
Figure 3E:
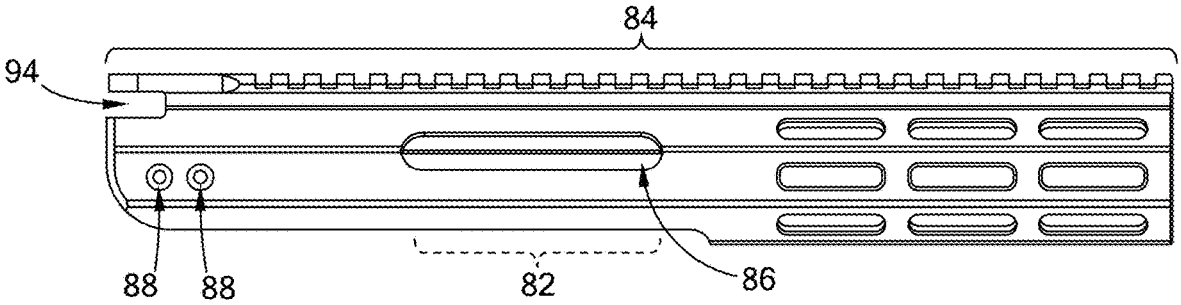
FIG. 3E is a right-side view of the handguard rail of FIG. 3A, according to the teachings of the present disclosure.
Figure 3F:
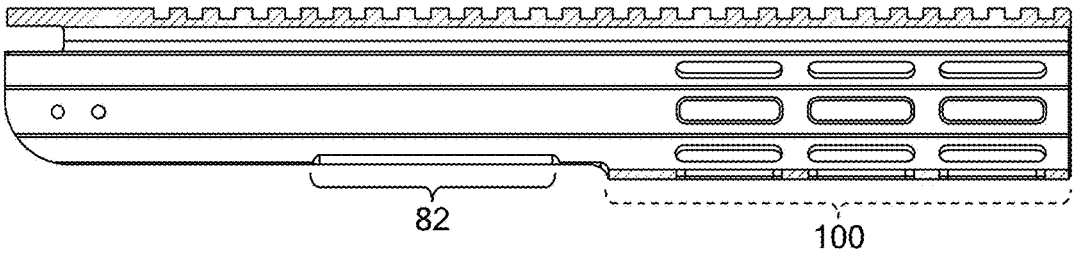
FIG. 3F is a cross-sectional view, taken along line 3F-3F of FIG. 3A, of the handguard rail of FIG. 3E, according to the teachings of the present disclosure.
Figure 3G:
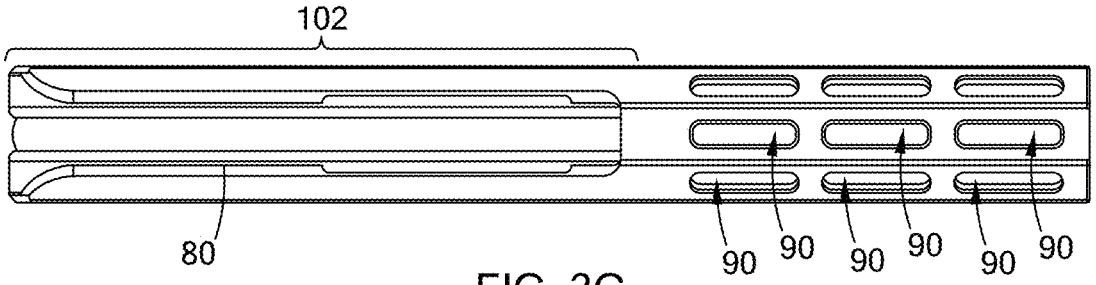
FIG. 3G is a bottom view of the handguard rail of FIG. 3A, according to the teachings of the present disclosure.
Figure 3H:
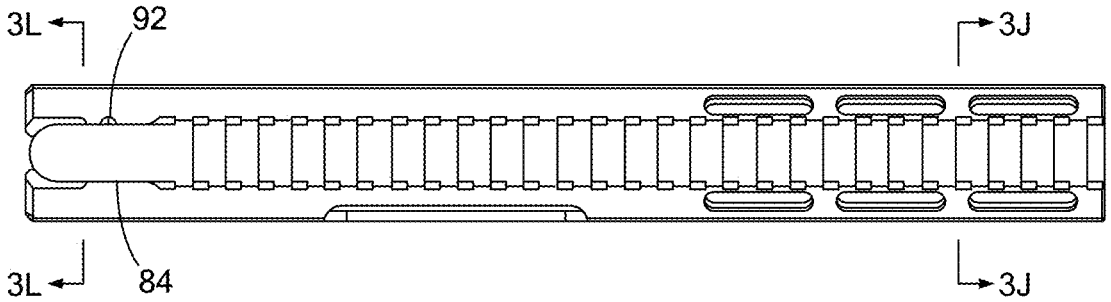
FIG. 3H is a top view of the handguard rail of FIG. 3A, according to the teachings of the present disclosure.
Figure 3I:
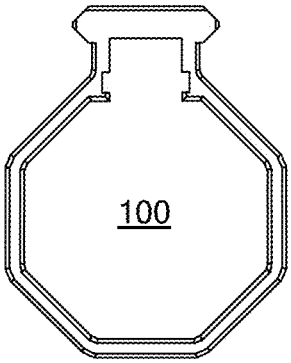
FIG. 3I is a front view of the handguard rail of FIG. 3A, according to the teachings of the present disclosure.
Figure 3J:
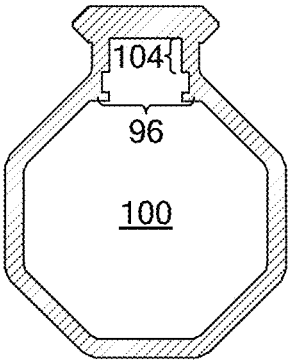
FIG. 3J is a cross-sectional view, taken along line 3J-3J of FIG. 3H, of the handguard rail, according to the teachings of the present disclosure.
Figure 3K:
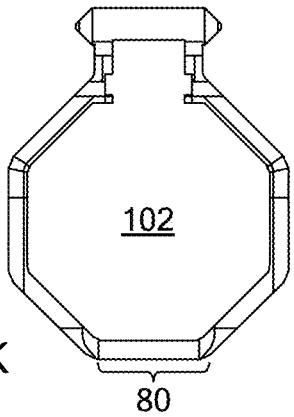
FIG. 3K is a rear view of the handguard rail of FIG. 3A, according to the teachings of the present disclosure.
Figure 3L:
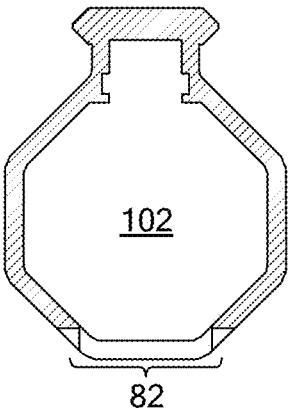
FIG. 3L is a cross-sectional view, taken along line 3L-3L of FIG. 3H, of the handguard rail, according to the teachings of the present disclosure.
Figure 3M:
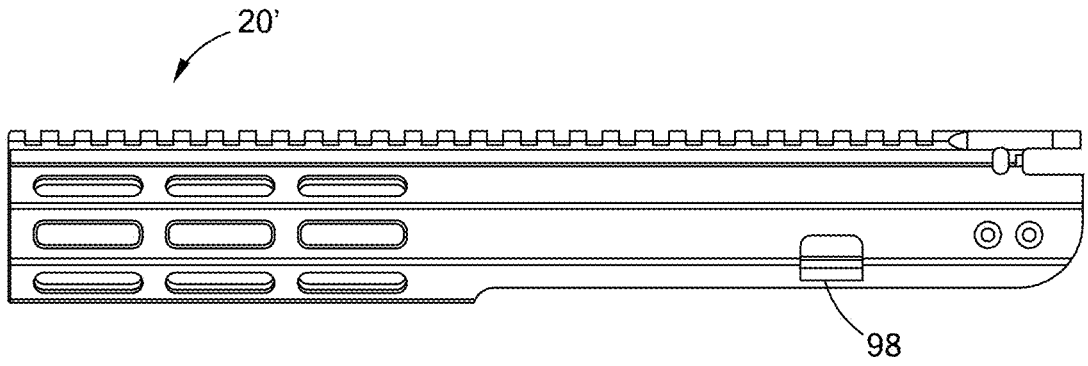
FIG. 3M is a view of the handguard rail of FIG. 3C with a bolt catch clearance slot, according to the teachings of the present disclosure.
Figure 3N:
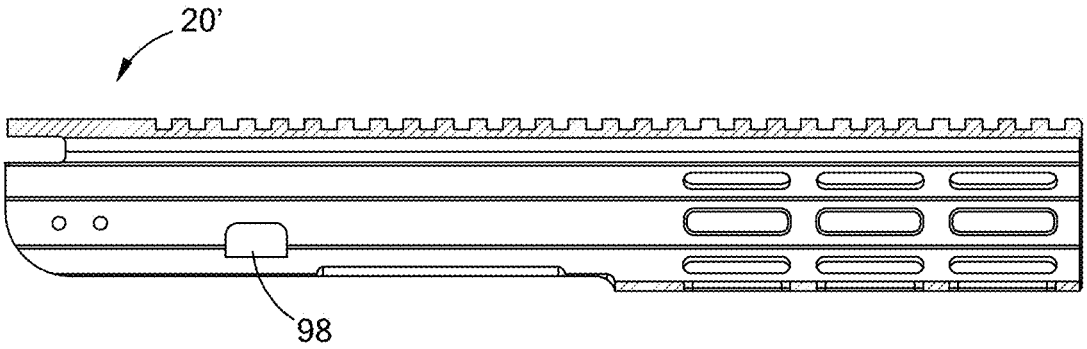
FIG. 3N is a view of the handguard rail of FIG. 3F with a bolt clearance slot, according to the teachings of the present disclosure.

Referring to FIGS. 3M and 3N the handguard rail 20' further comprises the bolt catch clearance slot 98 (compare FIG. 3C with FIG. 3M and FIG. 3F with FIG. 3N). The bolt catch clearance slot 98 enables the operator to release a bolt catch (not shown), the bolt catch captures the bolt after the last round (i.e. cartridge) has been discharged from the magazine. Traditionally, bolt catch clearance slots are firearm receiver components, during development of the combined firearm receiver and rail 10 of the present disclosure, the inventor was surprised to discover utility of a variation with and without an integrated the bolt catch clearance slot in the handguard rail 20.

Assembled Firearm Receiver and Rail

Figure 4A:
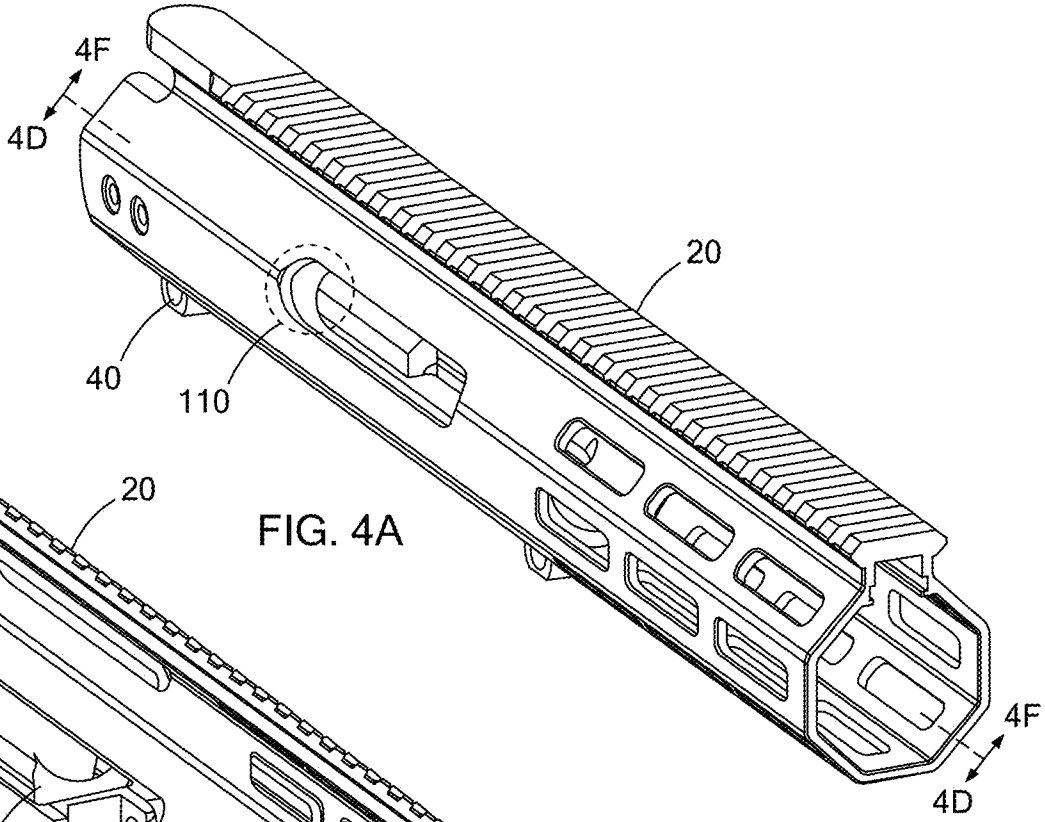
FIG. 4A is an assembled perspective top view of the combined firearm receiver and rail of FIG. 1A, according to the teachings of the present disclosure.
Figure 4B:
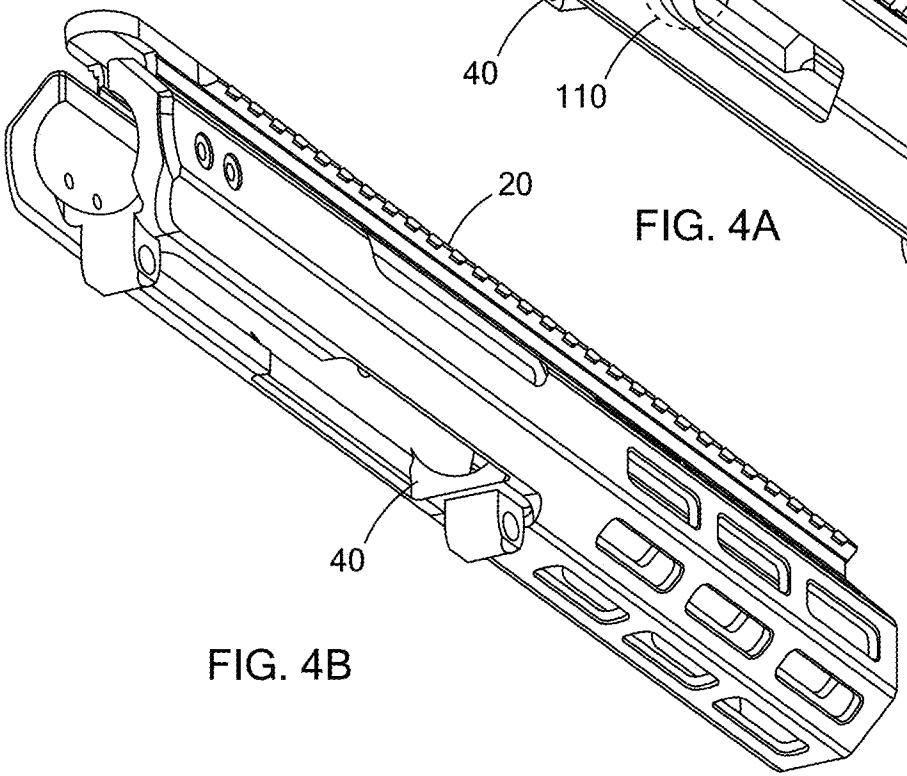
FIG. 4B is an assembled perspective bottom view of the combined firearm receiver and rail of FIG. 1B, according to the teachings of the present disclosure.
Figure 4C:
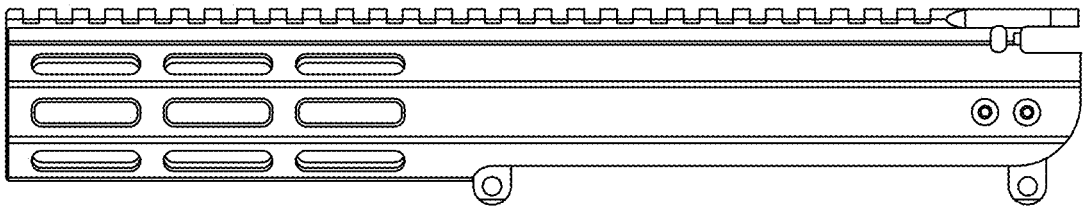
FIG. 4C is a left-side view of the combined firearm receiver and rail of FIG. 4A, according to the teachings of the present disclosure.
Figure 4D:
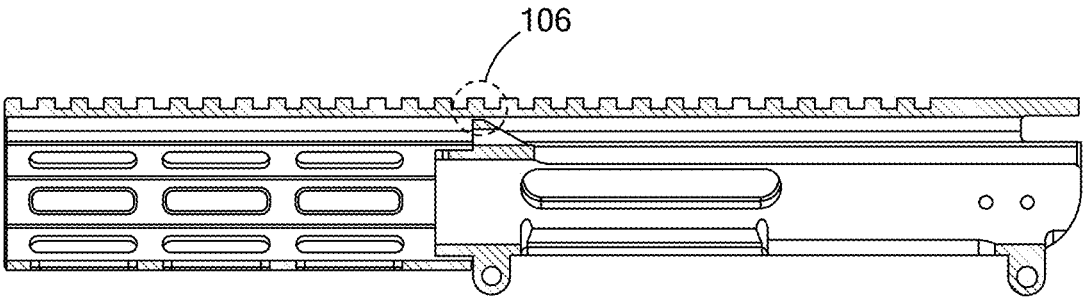
FIG. 4D is a cross-sectional view, taken along line 4D-4D of FIG. 4A, of the combined firearm receiver and rail, according to the teachings of the present disclosure.
Figure 4E:
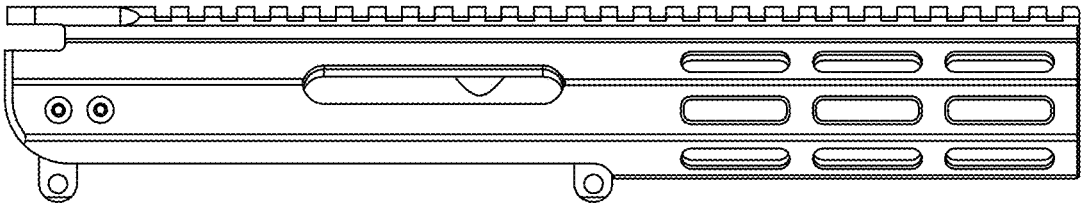
FIG. 4E is a right-side view of the combined firearm receiver and rail of FIG. 4A, according to the teachings of the present disclosure.
Figure 4F:
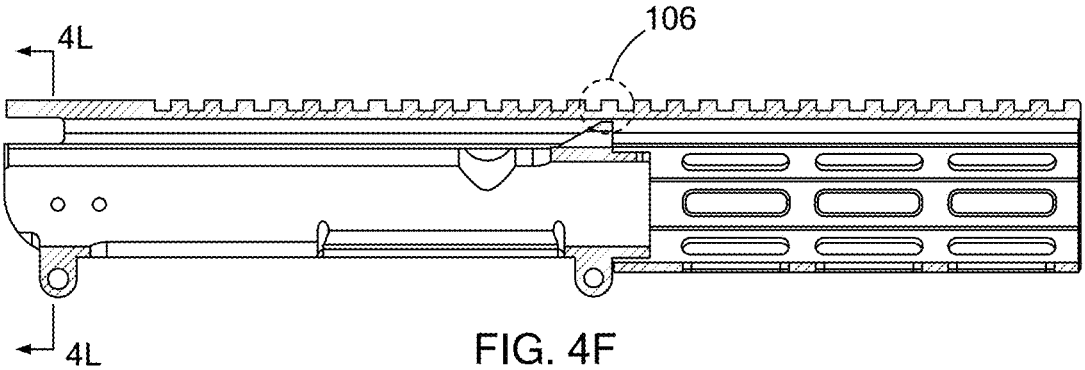
FIG. 4F is a cross-sectional view, taken along line 4F-4F of FIG. 4A, of the combined firearm receiver and rail, according to the teachings of the present disclosure.
Figure 4G:
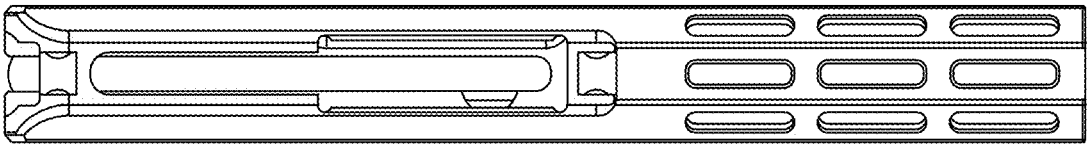
FIG. 4G is a bottom view of the combined firearm receiver and rail of FIG. 4A, according to the teachings of the present disclosure.
Figure 4H:
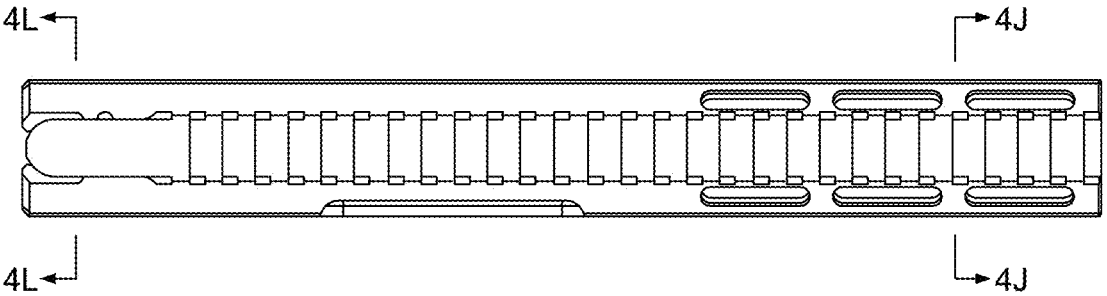
FIG. 4H is a top view of the combined firearm receiver and rail of FIG. 4A, according to the teachings of the present disclosure.

Referring now FIGS. 4A and 4B, the receiver housing 40 and handguard rail 20 are assembled and coupled together forming the combined firearm receiver and rail. This coupling also forms the integral shell deflector 110.

Referring to FIGS. 4C through 4L the combined firearm receiver and rail comprises the assembled gas line housing 50 of the receiver housing 40 that protrudes into the exhaust port 104 of the handguard rail 20 forming a combined firearm receiver and rail exhaust 106. Particularly, in FIG. 4J, the combined handguard rail 20 and the receiver housing 40 form the integral shell deflector 110, at the ejection port 46 and the handguard ejection port 86 out of the combined cross-sectional thickness of the handguard rail and the receiver housing 108. The integral shell deflector 110 is a unique feature of the combined firearm receiver and rail 10 and the integral shell deflector 110 redirects ejected shell casings away from the operator. Traditionally, shell deflectors both protrude from the exterior surface of the firearm receiver and are not formed from the combination of the firearm receiver and rail system.

Referring now to FIGS. 4I through 4L the combined firearm receiver and rail of the present disclosure, at least one of a front and a rear portion of either the handguard rail or the receiver housing defines a slotted octagonal cross-sectional area. The octagonal cross-sectional area improves firearm resistance to fulcrum, impulse, and torsional forces induced from operation of the firearm or impacts to the firearm or firearm accessories (e.g. handguard grips, mounts, optics, and range finders, among others) mounted to the handguard rail. These fulcrum, impulse, and torsional forces are capable of adversely affecting firearm performance such as jamming, misalignment, shot-on-shot accuracy, or rendering the firearm inoperable. The improved structural stability enabled by the octagonal cross-sectional area inhibits and reduces such degradation.

Slidable Coupling of Firearm Receiver and Rail

Figure 5A:
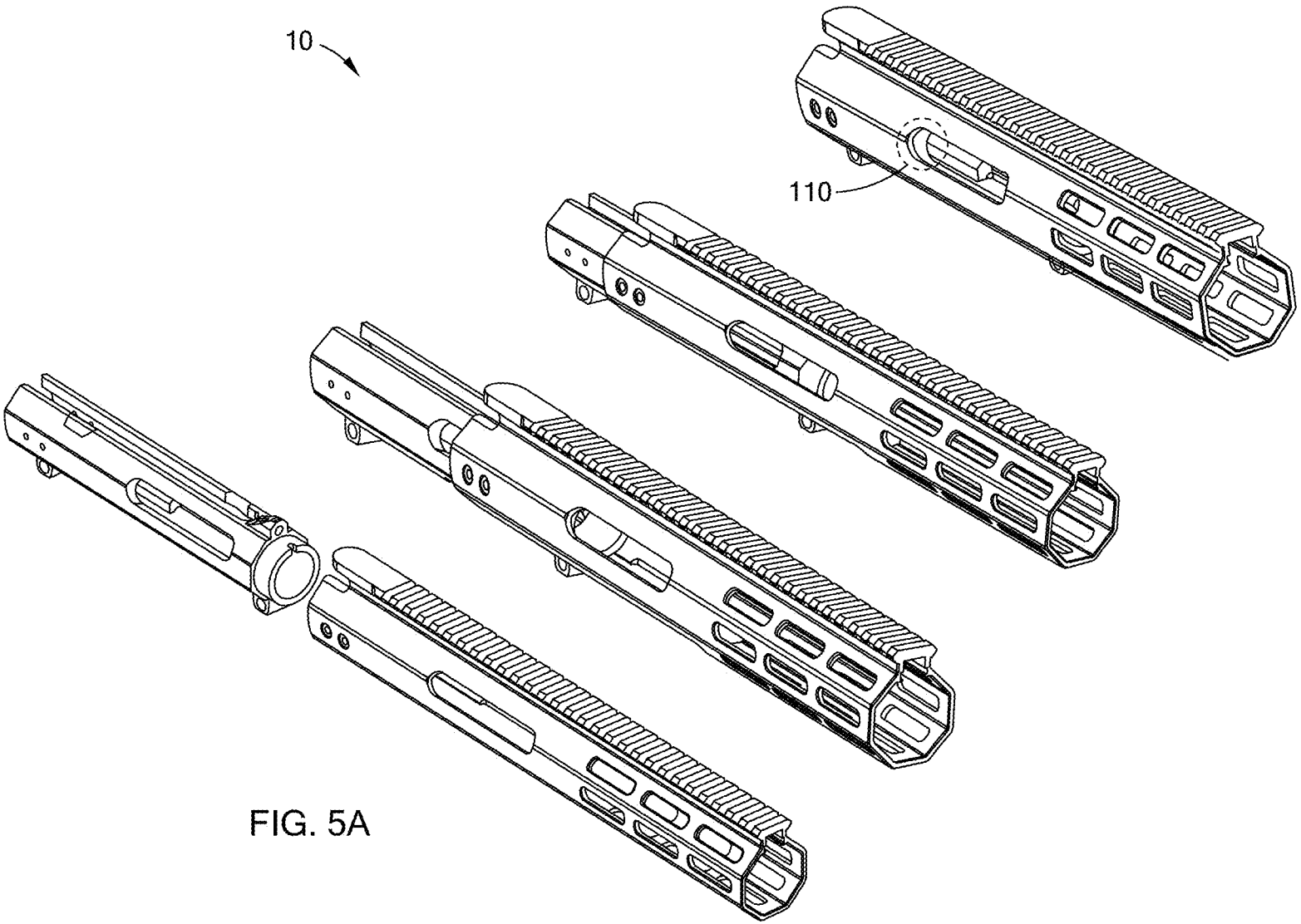
FIG. 5A is a perspective top view of the combined firearm receiver and rail of FIG. 4A and illustrates the slidable coupling, according to the teachings of the present disclosure.
Figure 5B:
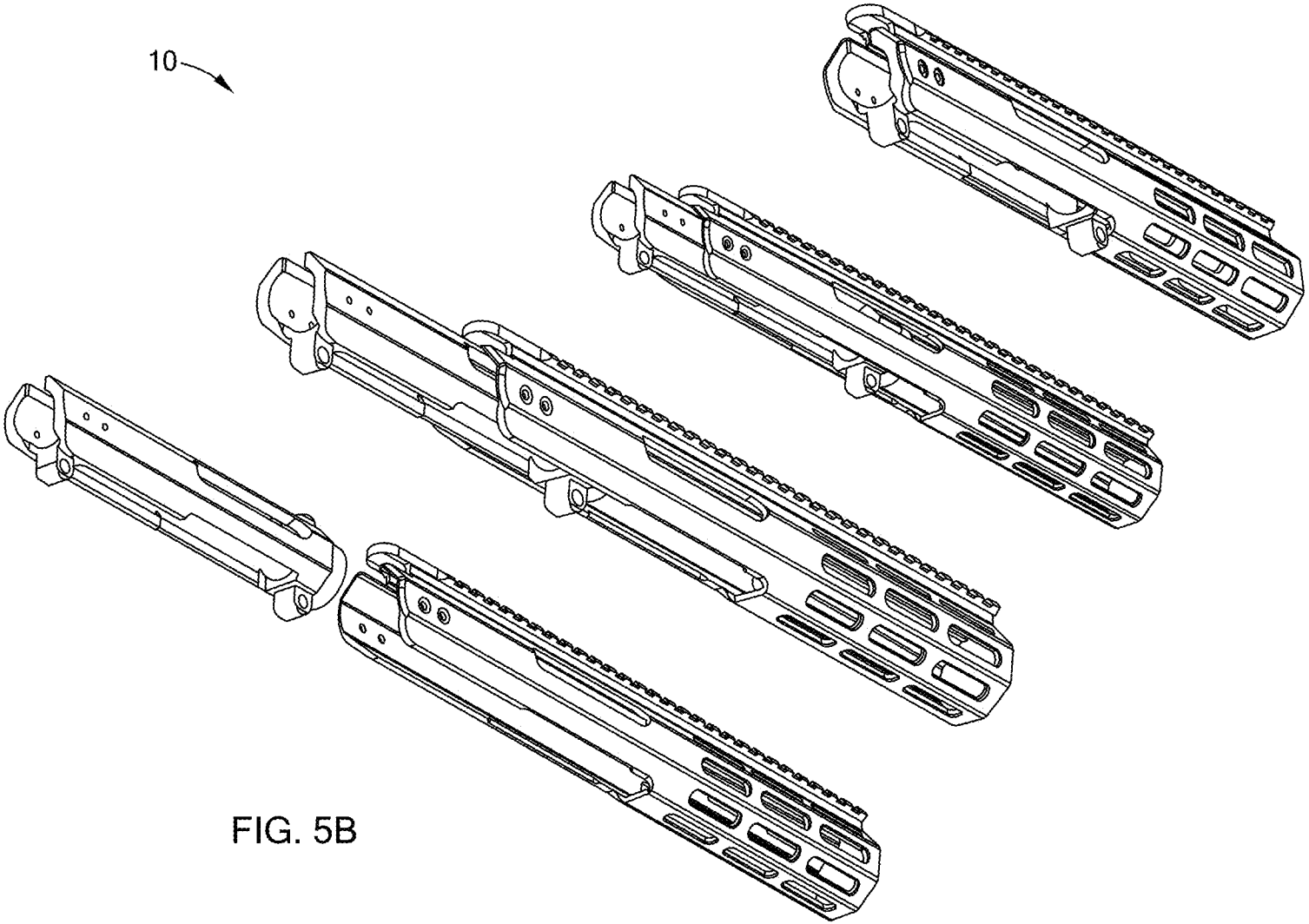
FIG. 5B is a perspective bottom view of the combined firearm receiver and rail of FIG. 4B and illustrates the slidable coupling, according to the teachings of the present disclosure.

Referring now to FIGS. 5A and 5B, the assembled combined firearm receiver and rail of the present disclosure. The slidable coupling of the handguard rail 20 and receiver housing 40 align smoothly improving the rigidity of the firearm and the coaxial boresight of the firearm as a whole. In at least one form, the thickness of the handguard rail 20 and receiver housing 40 combine to form the structural integrity desired for the firearm reducing the weight of the individual components without increasing the malfunction rate or intensity.

Particularly, FIG. 5A shows the formation of the integral shell deflector 110 as the handguard rail 20 and receiver housing 40 progressively couple.

At least one form of the present disclosure further comprises at least one of a dust cover and a forward assist secured to the handguard rail 20 or the receiver housing 40. A dust cover (ejection port cover) shields and/or seals the ejection port, inhibiting contaminants such as sand, dirt, or other debris from entering the firearm. A dust cover is a type of functional component. A forward assist pushes the bolt forward, ensuring that the bolt (or bolt carrier) is locked into position. Examples of dust covers and forward assists are shown in U.S. Pat. Nos. 5,918,401, 8,899,138, and 8,156,854, which are incorporated by reference herein in their entireties.

The receiver housing 40 and/or the handguard rail 20 of the present disclosure are enabled by various materials such as ceramics, metals, polymers and combinations thereof. In one form, magnesium and steel-based metals are employed. Further, the receiver housing 40 and/or the handguard rail 20 can manufactured by various methods including extrusion, investment casting, injection molding, machining, and additive manufacturing, among others.

Figure 4I:
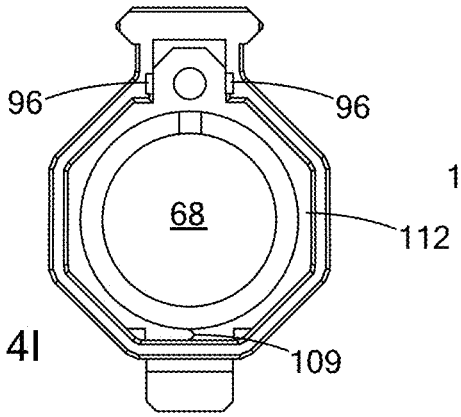
FIG. 4I is a front view of the combined firearm receiver and rail of FIG. 4A, according to the teachings of the present disclosure.
Figure 4J:
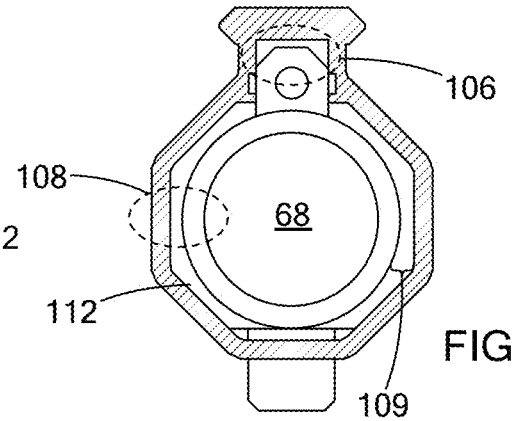
FIG. 4J is a cross-sectional view, taken along line 4J-4J of FIG. 4H, of the combined firearm receiver and rail, according to the teachings of the present disclosure.
Figure 4K:
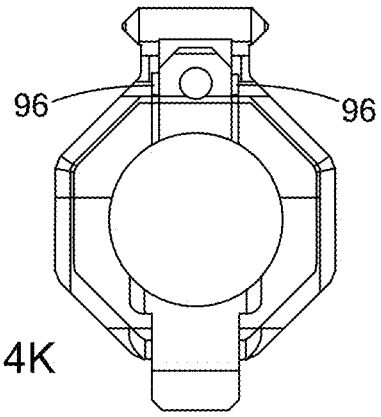
FIG. 4K is a rear view of the combined firearm receiver and rail of FIG. 4A, according to the teachings of the present disclosure.
Figure 4L:
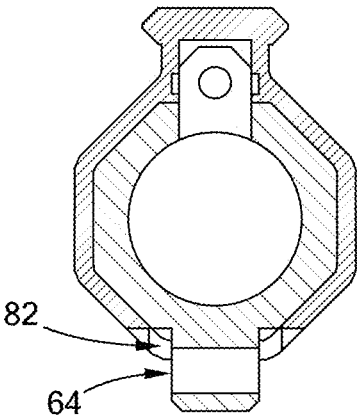
FIG. 4L is a cross-sectional view, taken along line 4L-4L of FIGS. 4F and 4H, of the combined firearm receiver and rail, according to the teachings of the present disclosure.

The developers were surprised to discover that in one form of the present disclosure the handguard rail 20 does not come into physical contact with the barrel 12 or the barrel nut 14 of the combined firearm receiver and rail 10. This was surprising because in all the rails the developers are familiar with the barrel or barrel nut is in contact with those rails. As shown in FIGS. 4I and 4J, a space 109 exists between the handguard rail 20 and the barrel receiver 54, which exceeds the distance between an outer diameter (surface) of the barrel nut 14 and an inner surface 112 of the handguard rail 20. In at least one form of the present disclosure, the distance between the outer diameter of the barrel nut 14 and the inner surface of the handguard rail 20 is at least 0.1 mm (0.004 in). This space 109 is advantageous because loads applied to the handguard rail 20 are not directly transferred to the barrel 12 or the barrel nut 14. When loads are transferred to the barrel 12 or the barrel nut 14 during operation, accuracy can be degraded.

In yet another combined firearm receiver and rail of the present disclosure, the handguard continuous rail 84 is a continuous picatinny rail.

In one form the present disclosure, the receiver housing comprises an integral shell deflector 110, and the combined cross-sectional thickness of the handguard rail and the receiver housing 108 is such that the integral shell deflector 110 of the receiver housing does not protrude away from an exterior surface of the handguard rail 20 the receiver housing 40.

Variations in Handguard Rail Lengths

Figure 6A:
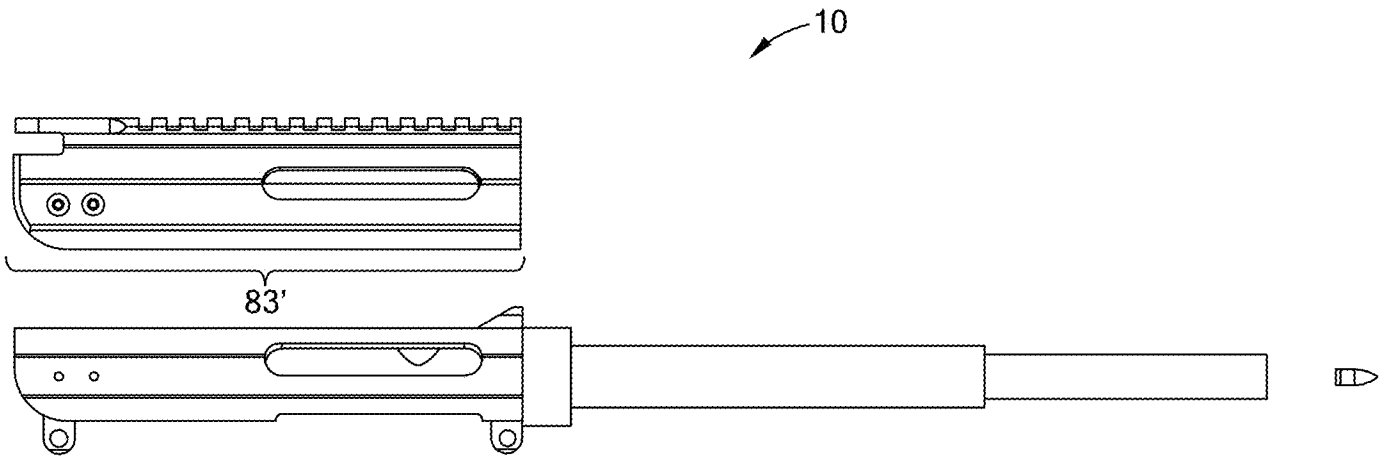
FIGS. 6A through 6F are right side views of the assembled combined firearm receiver and rail illustrating various handguard rail lengths, according to the teachings of the present disclosure.
Figure 6B:
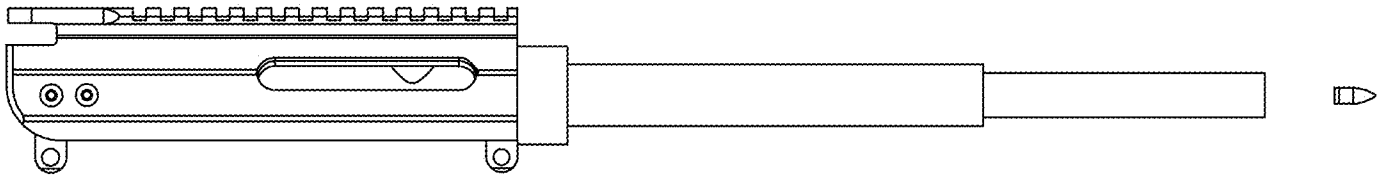
Figure 6C:
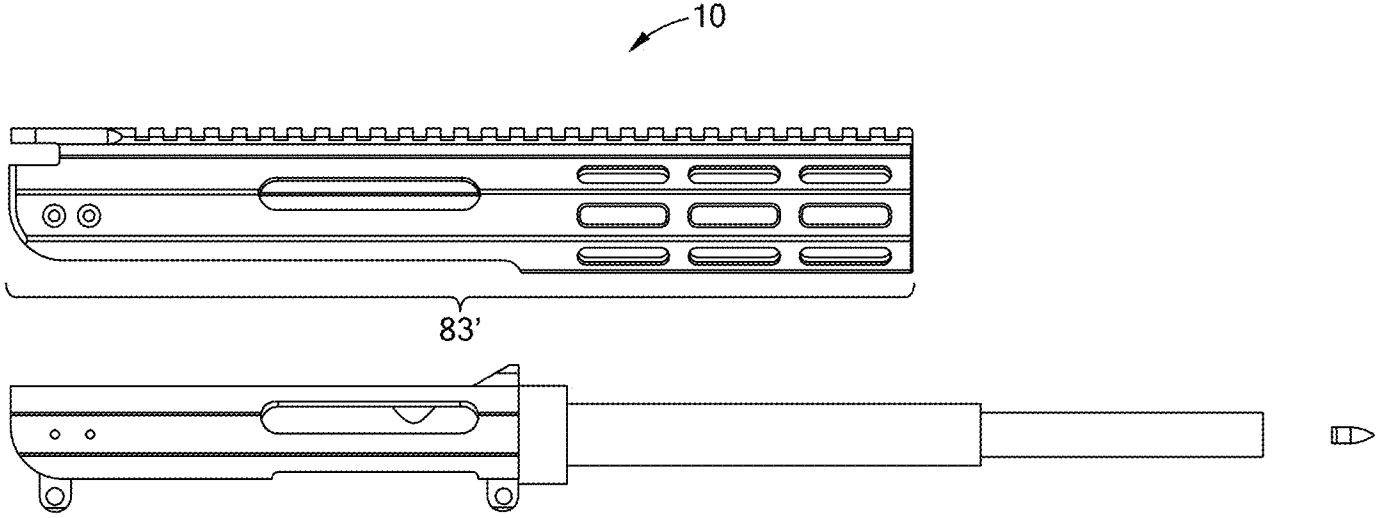
Figure 6D:
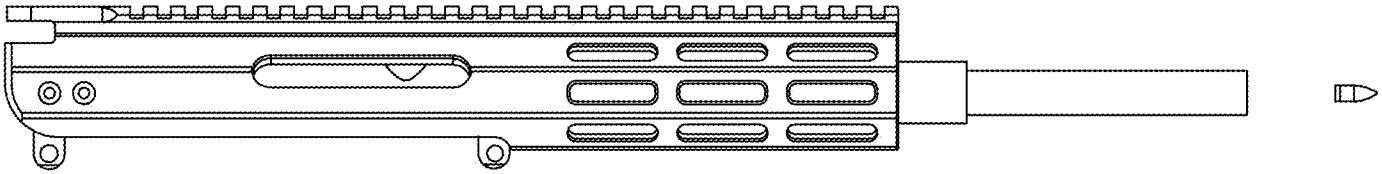
Figure 6E:
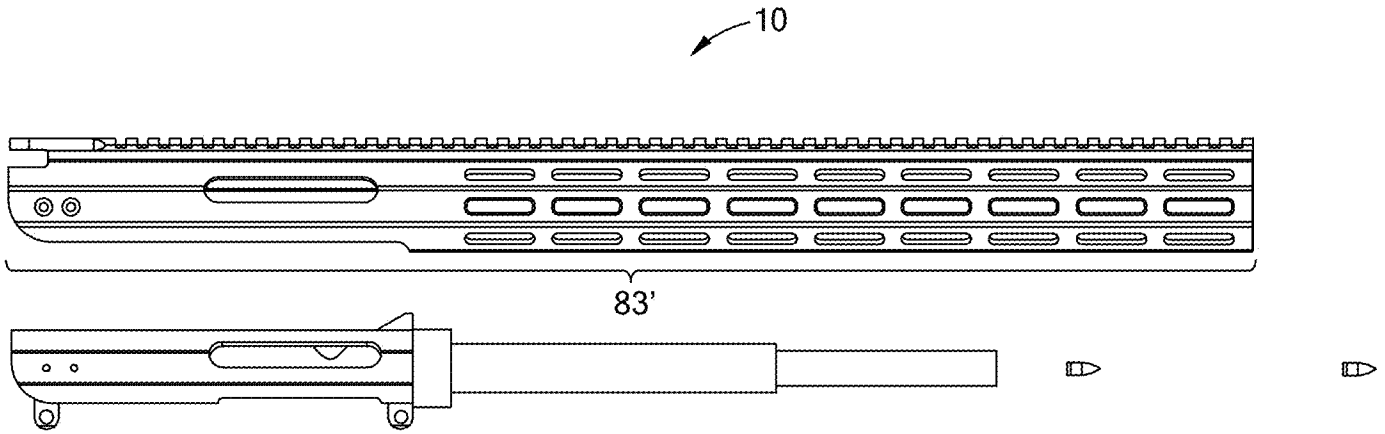
Figure 6F:
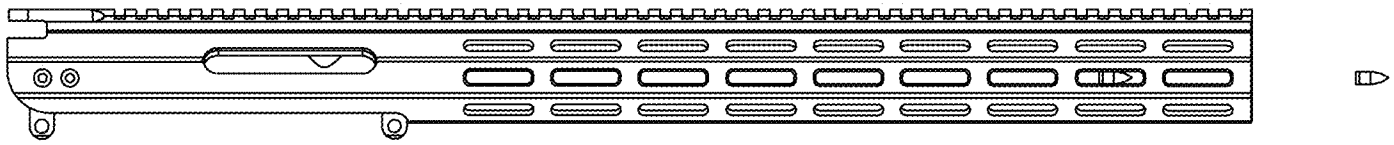

Now referring to FIGS. 6A through 6F the combined firearm receiver and rail of the present disclosure, the receiver housing couples to a handguard rail extending from rear portion of the receiver housing to an area ranging from over the receiver housing to distal from the end of the barrel (muzzle). These figures illustrate how the handguard section extends from the receiver housing rear portion to an area over a barrel of the firearm handguard section. In FIGS. 6A and 6B the handguard rail extends approximately to the gas line housing. In FIGS. 6C and 6D the handguard rail extends to a distance between the gas line housing and the end of the barrel (i.e. muzzle). In many forms of the combined firearm receiver and rail of the present disclosure the hand guard rail extends approximately to the end of the muzzle. In FIGS. 6E and 6F the handguard rail extends distal from the end of the muzzle.

As shown in FIGS. 6A through 6F the receiver housing defines a handguard section 83' extending from its rear portion to an area over a barrel of the firearm.

In at least one form of the present disclosure, the barrel extends from within, beyond, and substantially coplanar from the distal end of the handguard rail (FIGS. 6A through 6F).

Shouldered Cartridge

Figure 7A:
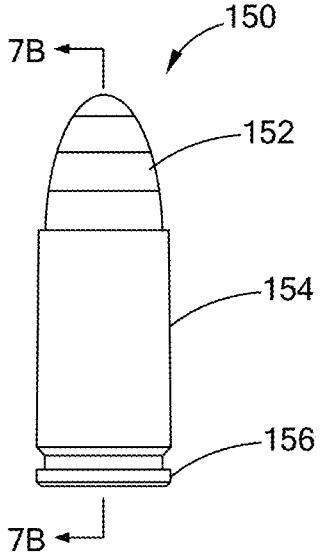
FIG. 7A PRIOR ART
FIG. 7A is a side view of a commercially available firearm cartridge.
Figure 7B:
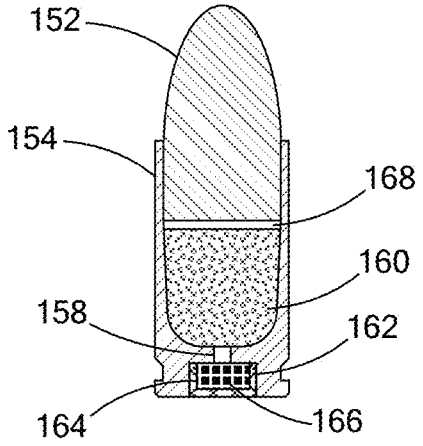
FIG. 7B PRIOR ART
FIG. 7B is a cross-sectional side view, taken along line 7B-7B of FIG. 7A, of the commercially available firearm cartridge.

Referring to FIGS. 7A and 7B, a commercially available cartridge 150 comprises at least one of a projectile 152, a shell casing 154, a shell casing rim 156, flash hole 158, a gunpowder cavity, gunpowder 160, a primer pocket 162, a primer cup 164, a primer compound 166, and a gunpowder-projectile gap 168. The shell casing 154 is a cone that slightly tapers from the shell casing rim 156 to the projectile 152. The degree of taper depends on the cartridge however, a 9 mm diameter shell casing tapers approximately 0.5 mm per 19 mm of length (+/−1 mm). The gunpowder cavity is adjacent to the flash hole 158; the flash hole 158 is adjacent to the primer pocket 162; and the gunpowder cavity and the primer pocket 162 on opposing ends of the flash hole 158.

The gunpowder cavity contains the gunpowder 160, the gunpowder-projectile gap 168, and the projectile 152; the projectile 152 is partially contained within the gunpowder cavity, and the gunpowder cavity is sealed by compressing the shell casing 154 around the projectile 152. The primer pocket 162 contains the primer compound 166 and the primer cup 164; while, the primer cup 164 seals the primer pocket 162.

Figure 8D:
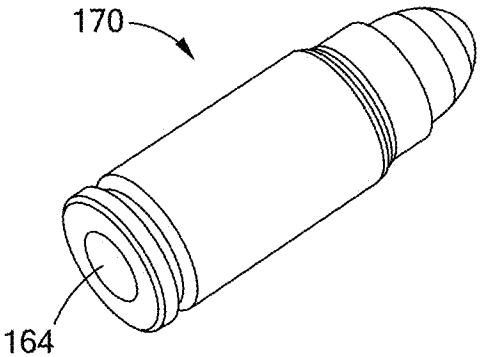
FIG. 8D is a perspective bottom view of the shouldered cartridge of FIG. 8A, according to the teachings of the present disclosure.
Figure 8C:
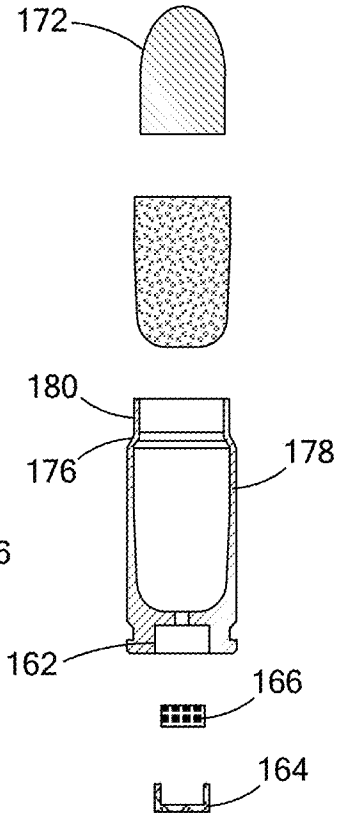
FIG. 8C is an exploded view of the shouldered cartridge of FIG. 8B, according to the teachings of the present disclosure.
Figure 8B:
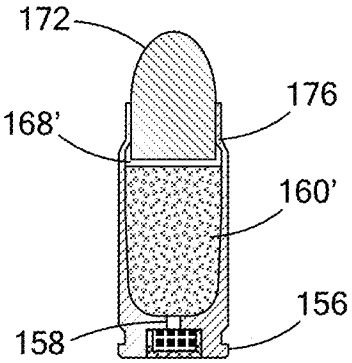
FIG. 8B is a cross-sectional side view, taken along line 8B-8B of FIG. 8A, of the shouldered cartridge, according to the teachings of the present disclosure.
Figure 8A:
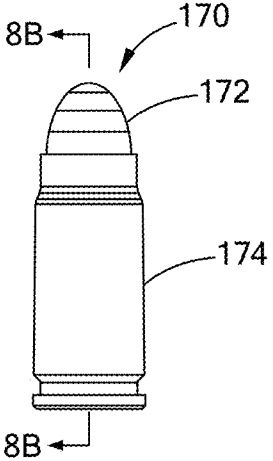
FIG. 8A is a side view and illustrates an exemplary shouldered cartridge, according to the teachings of the present disclosure.

Now referring to FIGS. 8A and 8B, another form of the present disclosure, a shouldered cartridge 170 is provided. The shouldered cartridge 170 comprises a projectile 172, a tapered shell casing 174, and a tapered shell casing shoulder 176, the shell casing rim 156, the flash hole 158, gunpowder 160', primer pocket 162, primer cup 164, primer compound 166, a gunpowder-projectile gap 168', and combinations thereof.

Referring to FIGS. 8C and 8D, the upper portion of tapered shell casing 174 includes a wide-tapered diameter 178, the tapered shell casing shoulder 176, and a narrow diameter 180 (reduced diameter neck portion). The wide-tapered diameter 178 extends from the shell casing rim 156 to the narrow diameter 180, and the tapered shell casing shoulder 176 transitions between the two diameters. The tapered shell casing shoulder 176 regulates the depth to which the cartridge slides into the barrel chamber. The wide-tapered diameter 178, the tapered shell casing shoulder 176, and the narrow diameter 180 are outer diameters of the tapered shell casing 74. In general, the length of the tapered shell casing 174 is longer than the standard casing by between 1 and 25.4 mm, in 0.5 mm increments, with a desired length of 4 mm longer. However, for certain applications, cartridges with more than 25.4 mm of additional shell casing will be desired. There is necessary variation due to the intended muzzle velocity and that a 12.7 mm cartridge will have a different additional length than a 5.56 mm cartridge.

Referring to FIG. 8E, a commercially available firearm barrel 190 is provided. The commercially available firearm barrel 190 comprises a bore 192 and a barrel chamber 194 with a barrel chamber seat 196 between them. The bore 192 extends from the barrel chamber seat 196 to the end of the firearm barrel (not shown).

Referring now to FIG. 8F, commercially available cartridge 150 is loaded within barrel chamber 194, with commercially available cartridge 150 coupling to the barrel chamber seat 196 and bore 192 forming a seal that allows gas pressure from firearm discharge to propel the projectile 152 properly (e.g. accurately) out of bore 192. The gas pressure propels the projectile 152 longitudinally and distally out of bore 192.

When shell casing 154 is loaded with a projectile (wildcat projectile) other than the projectile 152, a wildcat cartridge (not shown) is formed. The seal between the wildcat cartridge and the commercially available firearm barrel 190 is insufficient to direct the majority of the discharge pressure to propel the wildcat projectile longitudinally and distally out of the commercially available firearm barrel 190. An insufficient seal is formed between the shell casing 154, barrel chamber 194, and barrel chamber seat 196; thus, the majority of the discharge pressure is directed distally from the barrel chamber 194 towards the bore 192. Unfortunately, the insufficient seal also allows pressure to escape around the projectile, directed transverse to bore 192. The transverse discharge pressure creates excess Hoop stresses often causing shell casing 154 to rupture, often damaging at least one of the firearm, the operator, and the surrounding area also known as a misfire or malfunction. The projectile can also become jammed within bore 192 or the firing mechanism. Further, the majority of wildcat cartridges will not cycle the firearm action sufficiently to load another round.

Now referring to FIG. 8G, shouldered cartridge 170 is loaded within barrel chamber 194 and the tapered shell casing shoulder 176, narrow diameter 180, and bore 192 form a seal with barrel chamber seat 196 sufficient to propel projectile 172 out of bore 192, the seal is also sufficient to inhibit the transverse pressure and reducing the risk of malfunction. Further, the risk of damage to at least one of the firearm, the operator, and the surrounding area is also reduced. Note the accuracy may be reduced do to the lower pressure and engagement between the projectile 172 and bore rifling (not shown).

However, referring to FIG. 8H the desired configuration of the present disclosure, commercially available firearm barrel 190' is provided. Commercially available firearm barrel 190' comprises a bore 192', a barrel chamber 194', and a barrel chamber seat 196'. Barrel chamber seat 196' has an internal tapered shell casing shoulder that seals to the tapered shell casing shoulder of shouldered cartridge 170. Barrel chamber seat 196' and bore 192' are configured to properly form a seal sufficient for reliable accuracy; effectively, this is a wildcat cartridge in a firearm configured for the wildcat cartridge.

In one form of the present disclosure, the shouldered cartridge 170 is modified for use with a 9 mm receiver (not shown), with the desire being that the barrel is customized to accurately seat a 0.313 caliber projectile 172 instead of a 9 mm (0.36 inch) diameter projectile 152. The projectile has a 0.313 inch (7.95 mm) outer diameter (O.D.) and would be referred to as a 0.313 caliber projectile. The tapered shell casing 174 is approximately 0.9 inches (22.9 mm) long. The tapered shell casing shoulder 176 has an included angle of 60 degrees (+/−1 degree, with +/−0.5 degrees desired) between the wide-tapered diameter 178 and the narrow diameter 180. The wide-tapered diameter 178 has a 0.41-inch (10.5 mm) O.D. Where all diameters and lengths are subject to commercial manufacturing tolerances of +/−0.04 inches (1 mm) with a desired tolerance of +/−0.02 inches (0.5 mm). Enabling the 9 mm firearm to use 0.313-inch diameter projectiles.

In at least one form of the present disclosure a tapered shell casing 174 for use in a 9 mm firearm and for use in 9 mm magazines is provided. The shouldered cartridge 170 comprises a cavity for receiving a projectile 172 and an upper portion defining a tapered shell casing shoulder 176 transitioning into a narrow diameter 180 (reduced diameter neck portion) having an internal diameter from 0.313 inches (7.95 mm), wherein the tapered shell casing shoulder 176 is configured to abut an internal shoulder 196' within a chamber 194' of the 9 mm firearm.

In yet another form of the present disclosure, a shouldered cartridge 170 for use in a 9 mm firearm and for use in 9 mm magazines is provided. The shouldered cartridge 170 comprises a tapered shell casing comprising a cavity and an upper portion defining a tapered shell casing shoulder 176 transitioning into a narrow diameter 180 having an internal diameter from 0.313 inches (7.95 mm), a projectile 172 disposed within the cavity and secured therein by the narrow diameter 180, where gunpowder 160' is disposed within the cavity below the projectile 172. Enabling the 9 mm firearm to use 0.313-inch (7.95 mm) diameter projectiles 72.

Firearm Accessories

1. Catalytic Converter

Figure 9B:
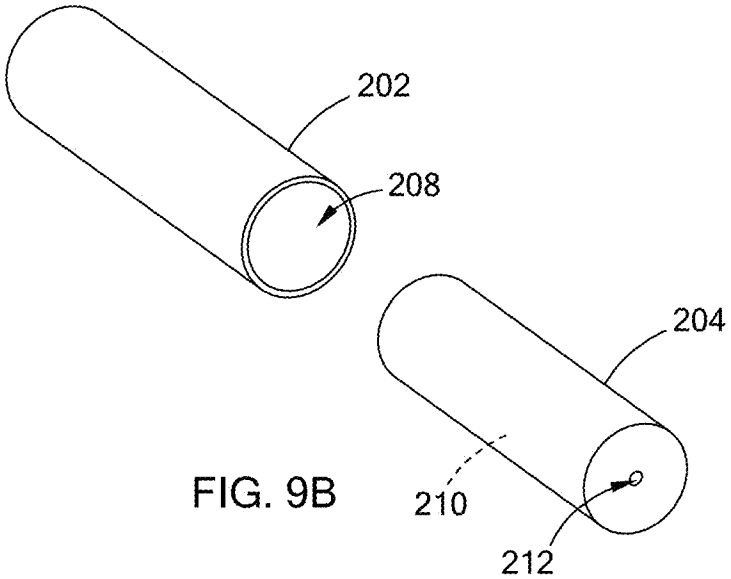
FIG. 9B is an exploded perspective top view of the catalytic converter of FIG. 9A, according to the teachings of the present disclosure.
Figure 9A:
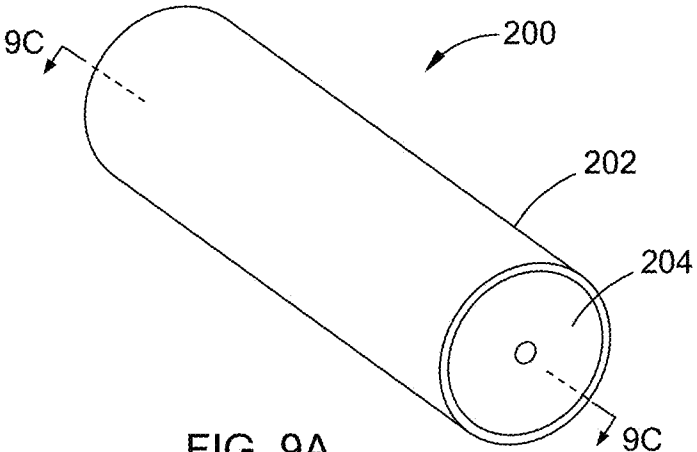
FIG. 9A is a top perspective view and illustrates an exemplary firearm catalytic converter, according to the teachings of the present disclosure.

Now referring to FIG. 9A, a firearm catalytic converter 200 is provided. The catalytic converter 200 comprises a first functional component 202 (e.g. housing, tubular body) and a bore body 204 (e.g. tubular core). The catalytic converter 200 is configured and enabled for a projectile to pass through the catalytic converter 200.

Figure 9C:
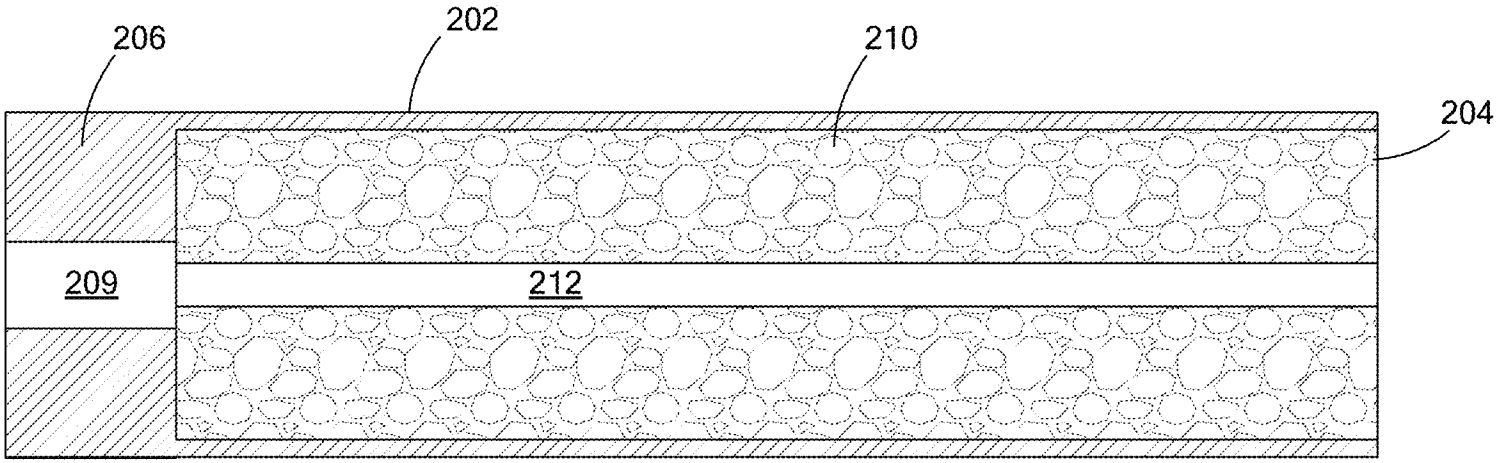
FIG. 9C is a cross-sectional side view, taken along line 9C-9C of FIG. 9A, of the catalytic converter, according to the teachings of the present disclosure.

Referring to FIGS. 9B and 9C, the tubular body 202 has two ends and includes at least one of a tubular body connector 206 and an internal bore 208 (e.g. tubular body cavity), wherein the tubular body connector 206 couples the catalytic converter 200 to at least one of a firearm barrel (not shown), and accessories (e.g. operator accessories, vehicle accessories, firearm accessories, firearm barrel accessories, among others; none shown). The tubular body connector 206 includes a bore 209 that is coaxially aligned with the firearm barrel (not shown) to allow the projectile to pass through the catalytic converter 200. The tubular core 204 couples to the tubular body cavity 208.

The tubular body core 204 has two ends and includes an open void material 210 and a tubular body core bore 212. The open void material 210 is enabled to evenly distribute the discharged gas throughout the voids. The open void material 210 reacts with firearm exhaust gases to reduce pollutants by converting toxic and harmful gases and pollutants in the firearm exhaust to less-toxic pollutants by increasing the rate of the oxidation and reduction reaction (e.g. catalytic conversion). The open void material 210 included voids that are at least one of closed-cell and open-cell; also, the voids may be a series of pathways, runnels, chambers, or other ovoid and polygonal shapes. The tubular body core bore 212 is coaxially aligned with the firearm barrel (not shown) to allow the projectile to pass through the catalytic converter 200.

The bore 209 and tubular body core bore 212 form an internal bore of the accessory to allow the projectile to pass through the catalytic converter 200.

In one form of the present disclosure a catalytic converter 200 for use with a firearm is provided. The catalytic converter 200 comprises a first functional component 202 (e.g. housing, tubular body) defining an internal bore 208 and a bore body 204 (e.g. tubular core) disposed within and filling the internal bore of the first functional component 202. The bore body 204 comprises an open void material 210 that reacts with exhaust gases of the firearm to reduce pollutants. Further, the bore body 204 includes voids; and the catalytic converter 200 is configured for attachment to a barrel of a firearm at a front-end portion (muzzle).

In at least one form of the present disclosure, the voids are at least one of closed-cell and open-cell.

In yet another form of the present disclosure a catalytic converter 200 for use with a firearm is provided. The catalytic converter 200 comprises a first functional component 202 disposed in-line with a barrel of the firearm and a bore body 204 secured to the first functional component 202 and defining an open void material 210 that reacts with exhaust gases of the firearm to reduce pollutants. The bore body 204 is at least one of solid and void-containing, and the voids are at least one of closed-cell and open-cell. In a form of the present disclosure, the first functional component 202 of the multi-use accessory is selected from the group consisting of a muzzle break, muzzle compensator, a flash hider, a sound suppressor, and a gas line. While not shown, additional functional components (e.g. second, third, fourth, among others) are disposed similarly to first functional component 202.

2. Suppressor

Figure 10A:
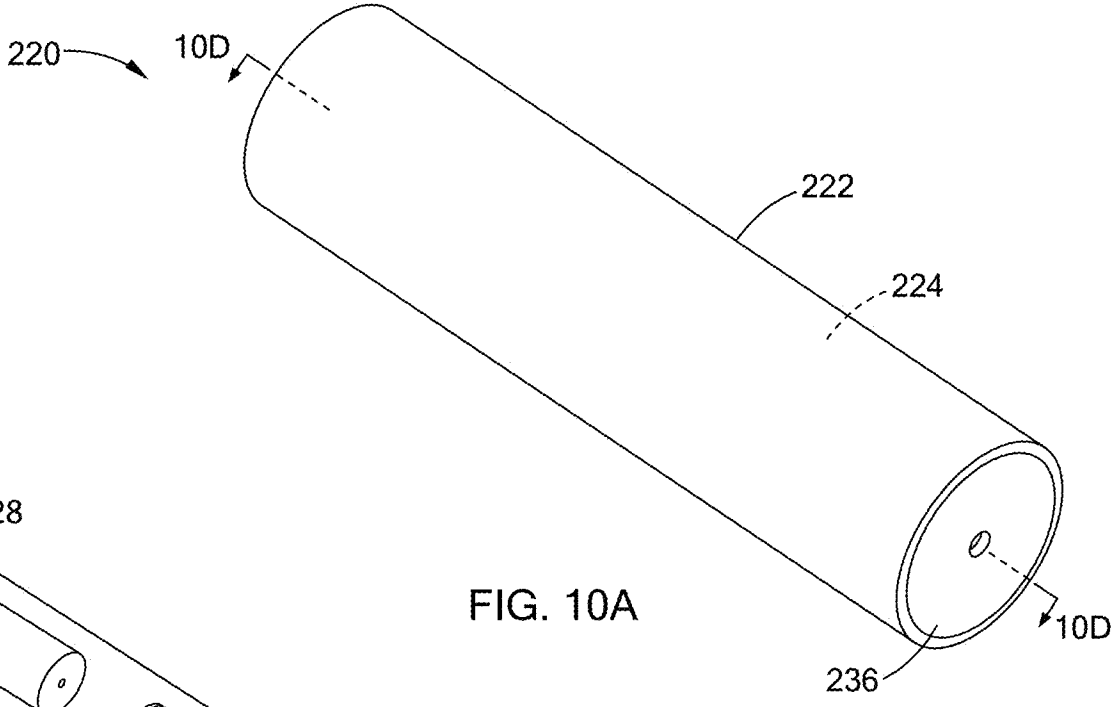
FIG. 10A is a top perspective view and illustrates an exemplary firearm suppressor, according to the teachings of the present disclosure.

Referring now to FIG. 10A, a firearm suppressor 220 is provided. The firearm suppressor 220 comprises a suppressor body 222 and a suppressor core 224. The firearm suppressor 220 is configured and enabled for a projectile to pass through the firearm suppressor 220.

Figure 10B:
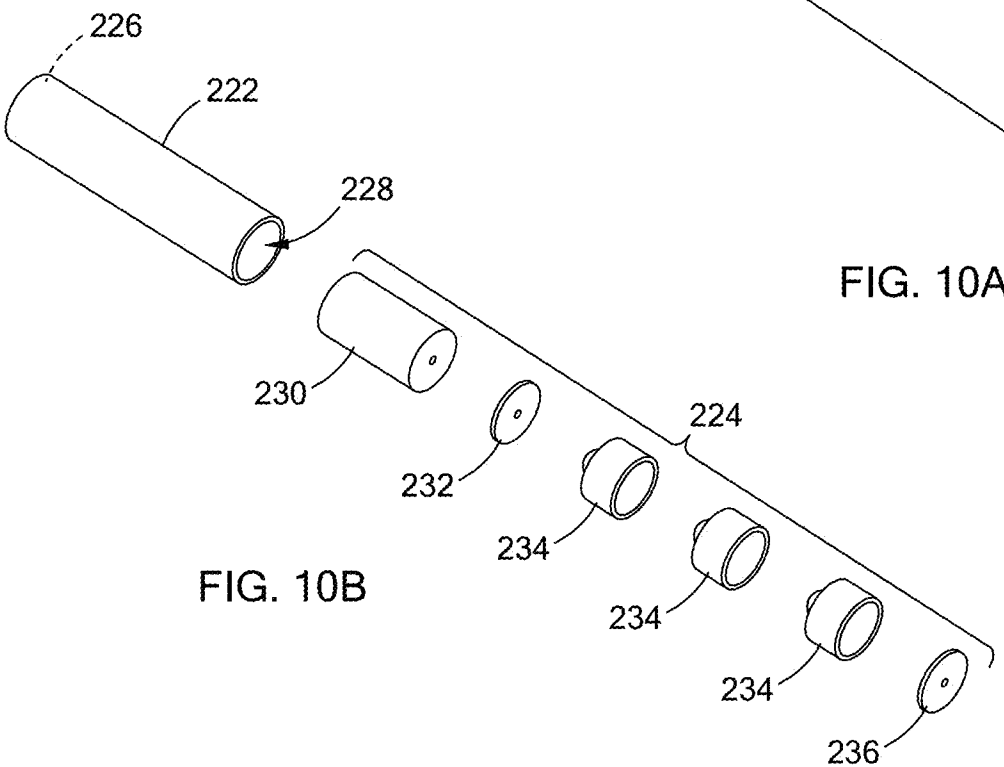
FIG. 10B is an exploded perspective top view of the suppressor of FIG. 10A, according to the teachings of the present disclosure.
Figure 10C:
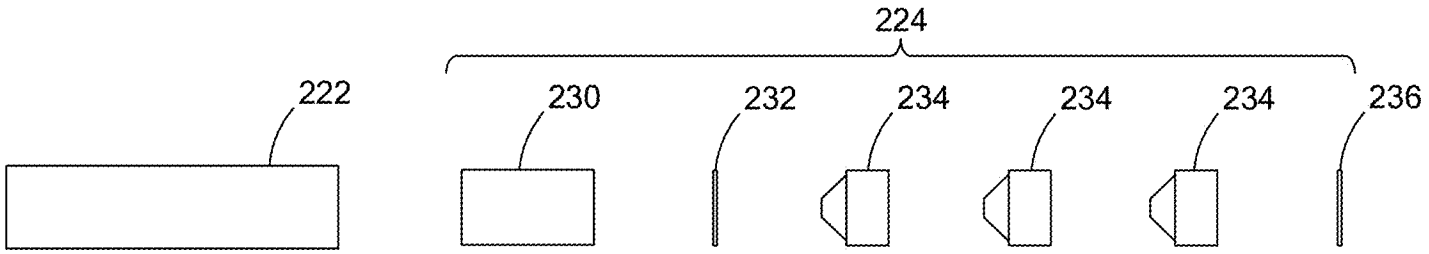
FIG. 10C is an exploded side view of the suppressor of FIG. 10A, according to the teachings of the present disclosure.
Figure 10D:
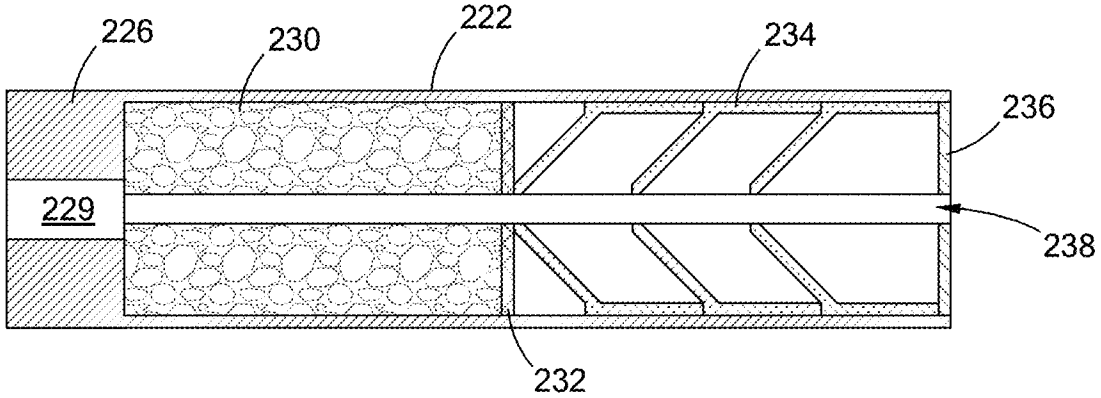
FIG. 10D is a cross-sectional side view, taken along line 10D-10D of FIG. 10A, of the suppressor, according to the teachings of the present disclosure.

Referring to FIGS. 10B and 10D, the suppressor body 222 comprises two ends and at least one of a suppressor body connector 226, a suppressor body cavity 228, and a suppressor body bore 229. The suppressor body connector 226 couples the suppressor to at least one of a firearm barrel (not shown), accessories (e.g. operator accessories, vehicle accessories, firearm accessories, firearm barrel accessories, among others; none shown). The suppressor core 224 couples to the suppressor body cavity 228.

Now referring to FIGS. 10B through 10D, the suppressor core 224 comprises at least one of a catalytic converter 230, a bushing 232, a gap (not shown), a blast chamber (not shown), a flash hider (not shown), wipes (not shown), a spindle (not shown), muzzle break (not shown), a gas trap (not shown), a muffler (not shown), a Nielsen device (not shown), a baffle 234, a cap 236, and a suppressor core bore 238. The suppressor body bore 229 and suppressor core bore 238 are coaxially aligned with the firearm barrel (not shown) to allow the projectile to pass through the firearm suppressor 220.

3. Flash Hider

Figure 11B:
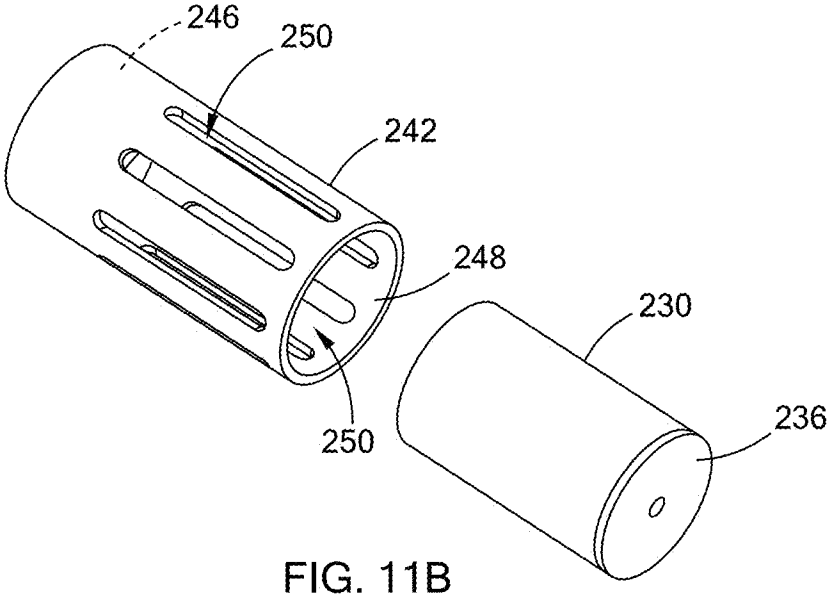
FIG. 11B is an exploded side view of the flash hider of FIG. 11A, according to the teachings of the present disclosure.
Figure 11C:
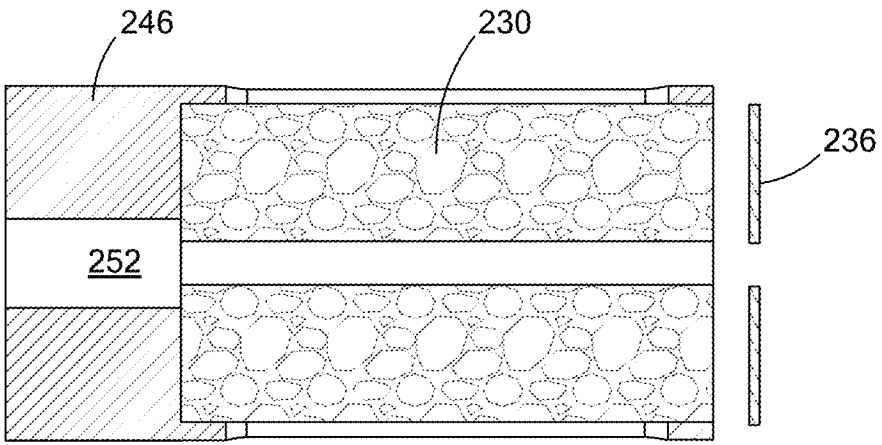
FIG. 11C is a cross-sectional partially exploded side view, taken along line 11C-11C of FIG. 11A, of the flash hider, according to the teachings of the present disclosure.
Figure 11A:
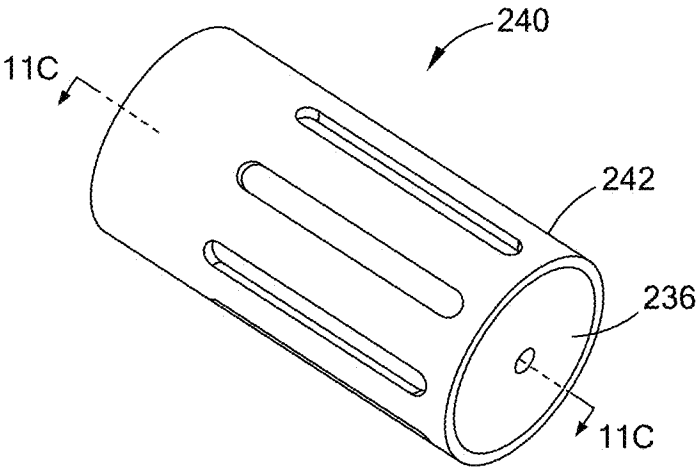
FIG. 11A is a top perspective view and illustrates an exemplary flash hider, according to the teachings of the present disclosure.

Referring to FIG. 11A, a flash hider 240 is provided. The flash hider 240 comprises at least one of a hider body 242 and a cap 236. The flash hider 240 is configured and enabled for a projectile to pass through the flash hider 240.

Referring now to FIGS. 11B and 11C, the hider body 242 has two ends and includes at least one of a hider body connector 246, a hider body cavity 248, and a gas vent 250, wherein the hider body connector 246 couples the flash hider 240 to at least one of a firearm barrel (not shown) and accessories (e.g. operator accessories, vehicle accessories, firearm accessories, firearm barrel accessories, among others; none shown). The hider body connector 246 includes a bore 252 that is coaxially aligned with the firearm barrel (not shown) to allow the projectile to pass through the flash hider 240. The hider body connector 246 couples to the hider body cavity 248. While flash hider 240 is shown with a catalytic converter 230, the catalytic converter 230 is not required.

The gas vent 250 regulates the release of discharge gas to mitigate the effects of firearm recoil on the barrel, improve time on target, decrease visible signature from firing, and combinations thereof. The gas vent 250 is a slot (e.g. polygonal, ovoid, and combinations thereof) connecting an exterior of the hider body to the hider body cavity 248.

4. Gas Tube

Figure 12B:
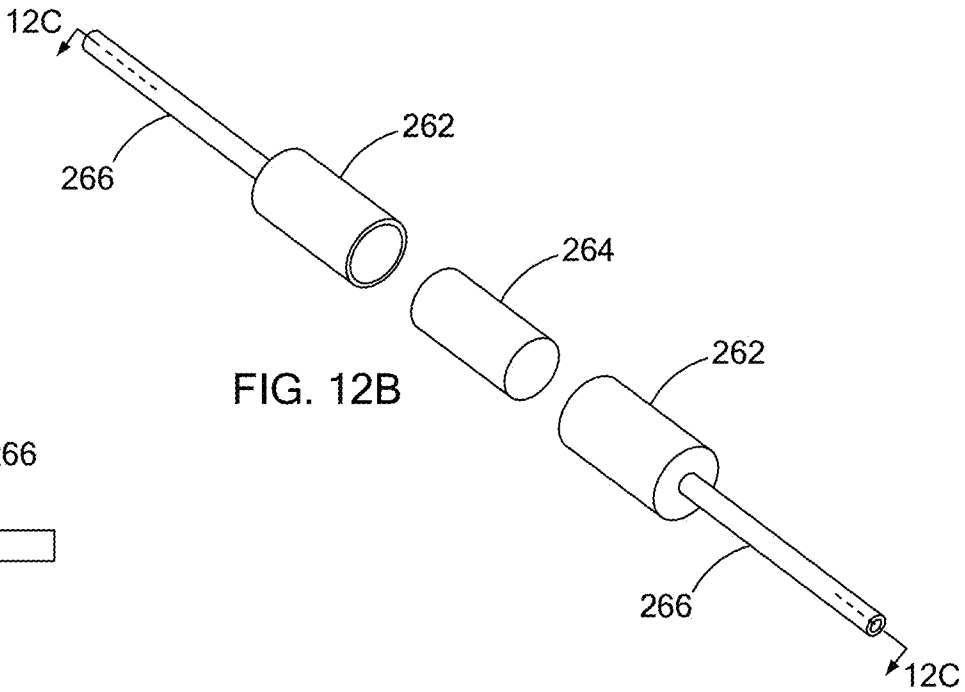
FIG. 12B is an exploded perspective top view and illustrates another exemplary gas tube, according to the teachings of the present disclosure.
Figure 12A:
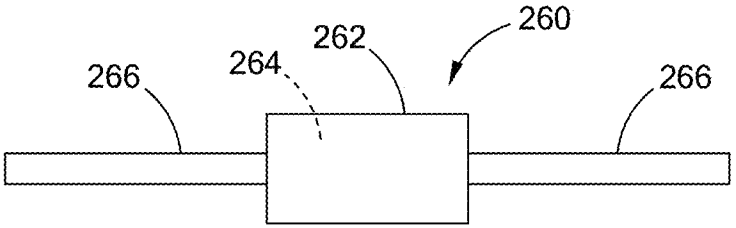
FIG. 12A is a side view and illustrates an exemplary gas tube, according to the teachings of the present disclosure.
Figure 12C:
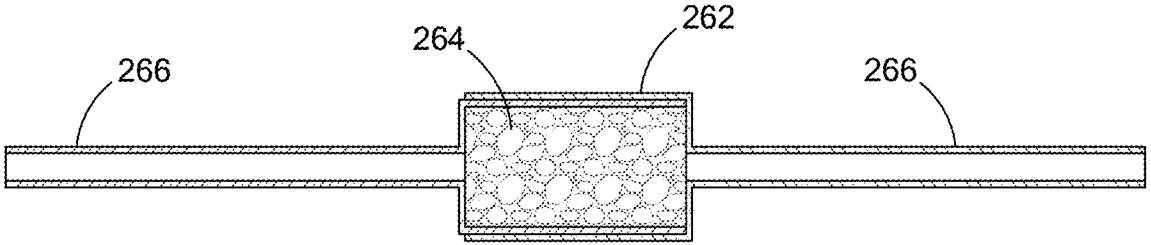
FIG. 12C is a cross-sectional view, taken along line 12C-12C of FIG. 12B, of the gas tube, according to the teachings of the present disclosure.

Now referring to FIG. 12A, a gas tube 260 is provided. The gas tube 260 comprises two ends and at least one of an exhaust chamber 262, a catalytic converter 264, and a tube 266. Some possible design variations are provided in FIGS. 12A through 12F.

The exhaust chamber 262 has a larger volume per linear distance travelled than the tube 266. The firearm exhaust can accumulate in the exhaust (gas) chamber. Notably, in FIGS. 12B and 12C, the exhaust chamber 262, is formed by two funnels that slidably couple to each other with the catalytic converter 264 within.

The tube 266 has two ends and couples to at least one of the exhaust chamber 262, the catalytic converter 264, the gas block (not shown) on one end, and the gas key (not shown) on the other end. The tube 266 has a cross-section that is at least one of ovoid, polygonal, and combinations thereof.

Figure 12D:
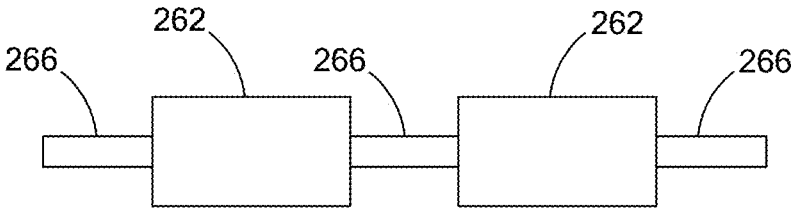
FIG. 12D is a side view and illustrates the gas tube of FIG. 12A with more than one exhaust chambers, according to the teachings of the present disclosure.
Figure 12E:
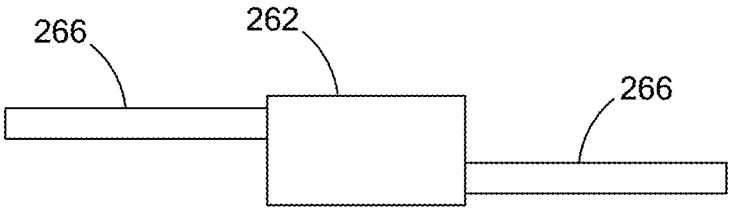
FIG. 12E is a side view and illustrates the gas tube of FIG. 12A with off-center tubes, according to the teachings of the present disclosure.

Referring to FIGS. 12A and 12E, the two gas tubes 260 are translated with respect to each other and the exhaust chamber 262, while not shown in FIG. 12D, the middle tube 266 could also be translated with respect to the other the two gas tubes 260 and exhaust chamber 262.

Figure 12F:
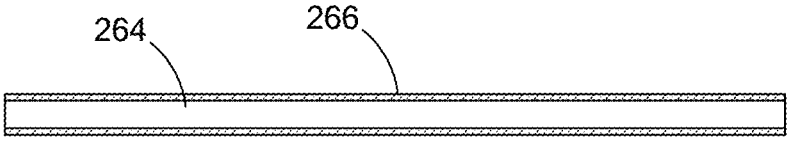
FIG. 12F is a cross-sectional view and illustrates an exemplary gas tube as a catalytic converter and a tube, according to the teachings of the present disclosure.

Referring now to FIG. 12F, the gas tube of the present disclosure, the catalytic converter 264 is on the inside wall of the tube 266.

Definitions:

Bolt lugs engage trunnion lugs and retain the gas pressure from discharging the firearm. The gas pressure is what propels the projectile out of the firearm.

A cam is a rotating or sliding piece in a mechanical linkage that transforms rotary motion into linear motion or linear motion into rotary motion. The cam moves the bolt carrier, which engages the cam pin, which rotates the bolt and opens the firearm action.

The charging handle couples with the bolt carrier; the charging handle retracts the bolt and bolt carrier to load a cartridge, unload a cartridge, or aid in clearing a malfunction.

A conventional rail system has multiple components (segments) that form the rail, as part of the rail is on the firearm and part of the rail is on the handguard. A rail system is a bracketing configuration used on some firearms to provide a standardized mounting platform. There are various types of bracketing configurations, such as Picatinny, Weaver, Warsaw Pact, NATO Accessory, Dovetail, KeyMod, the bracket sold under M-LOK®, and others.

A flash hider, also known as a flash suppressor, couples to the muzzle of a firearm to reduce the firearm's visible signature while firing by cooling or dispersing the burning gases that exit the muzzle. A flash hider is a type of functional component.

The gas line redirects a portion of high-pressure gas from the fired cartridge to provide motion for unlocking of the action; extracting the spent cartridge, ejecting the spent cartridge; cocking the hammer or striker; chambering a fresh cartridge; and locking of the action. A gas line is a type of functional component.

The muzzle is the front end of barrel from which the projectile exits.

A muzzle break, also known as a recoil compensator, couples to the muzzle of a firearm to redirect propellant gasses to counter recoil and unwanted barrel (muzzle) rise. A muzzle break is a type of functional component.

Muzzle rise is the tendency of a firearms front end (muzzle) of the barrel to rise up after firing.

A recoil booster (e.g. muzzle booster, Nielsen device) couples to the muzzle of a firearm and harnesses the energy of the escaping propellant to augment the force of recoil on portions of the firearm. A recoil booster decouples the weight of the suppressor from the barrel when fired, allowing the firearm to properly operate by boosting the recoil energy of the barrel and slide and temporarily decreasing the effective attached weight. A recoil booster is a type of functional component.

Tubular includes ovoid polygonal, and sinusoidal shapes and/or cross-sections, and combinations thereof.

Although the terms first, second, third, among others may be used herein to describe various elements, components, regions, layers and/or sections, these elements, components, regions, layers and/or sections, should not be limited by these terms. These terms may be only used to distinguish one element, component, region, layer and/or section, from another element, component, region, layer and/or section. Terms such as "first," "second," and other numerical terms when used herein do not imply a sequence or order unless clearly indicated by the context. Thus, a first element, component, region, layer or section, could be termed a second element, component, region, layer or section without departing from the teachings of the example forms. Furthermore, an element, component, region, layer or section may be termed a "second" element, component, region, layer or section, without the need for an element, component, region, layer or section termed a "first" element, component, region, layer or section.

Spacially relative terms, such as "inner," "outer," "below," "lower," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" other elements or features would then be oriented "above" the other elements or features. Thus, the example term "below" can encompass both an orientation of above or below. The device may be otherwise oriented (rotated 90 degrees or at other orientations) and the spatially relative descriptors used herein interpreted accordingly.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, material, manufacturing, and assembly tolerances, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A combined firearm receiver and rail comprising:

a handguard rail;

a receiver housing disposed within the handguard rail; and a handguard section that does not come into physical contact with a barrel or a barrel nut of the firearm, and wherein the handguard section extends from a rear portion of the handguard rail to an area over a barrel of the firearm, wherein the handguard rail comprises a charging handle guideway, the charging handle guideway extending along an entire length of the handguard rail.

2. The combined firearm receiver and rail according to claim 1, wherein the receiver housing further comprises an integral barrel trunnion.

3. The combined firearm receiver and rail according to claim 1 further comprising a dust cover secured to at least one of the handguard rail and the receiver housing.

4. The combined firearm receiver and rail according to claim 1, wherein the handguard rail is mechanically secured to the receiver housing.

5. The combined firearm receiver and rail according to claim 4, wherein the mechanical securing is one of a screw, a bolt, a quick detach latch, a clasp, a spring-loaded button, a press-fit, and combinations thereof.

6. The combined firearm receiver and rail according to claim 1, wherein a rear portion of at least one of the handguard rail and the receiver housing defines a slotted octagonal cross-sectional area.

7. The combined firearm receiver and rail according to claim 1, wherein at least one of the handguard rail and the receiver housing are a magnesium material.

8. The combined firearm receiver and rail according to claim 1, wherein at least one of the handguard rail and the receiver housing are a polymeric material.

9. The combined firearm receiver and rail according to claim 1, wherein at least one of the handguard rail and the receiver housing is manufactured by a method selected from the group consisting of extrusion, investment casting, injection molding, machining, and additive manufacturing.

10. The combined firearm receiver and rail according to claim 1, further comprising a handguard continuous rail, and wherein the handguard continuous rail is a continuous picatinny rail.

11. A combined firearm receiver and rail comprising:

a handguard rail; and a receiver housing disposed within the handguard rail, wherein the handguard rail comprises a takedown lug clearance slot, a handguard magazine port, a handguard continuous rail, a handguard ejection port, an attachment location, accessory attachment points, a handguard charging handle latch retaining slot, a charging handle housing, a charging handle guideway, a bolt catch clearance slot, a barrel cavity, a receiver cavity, a shell deflector, an exhaust port, a handguard section, and an integral shell deflector, wherein the receiver housing comprises a gas key clearance slot, a cam pin clearance cut-out, an ejection port, a fastening location, a gas line housing, a gas line, barrel receiver, a trunnion pin slot, a magazine port, a fire control group opening, a takedown lug, a takedown lug pin hole, a gas key slot opening, a trunnion port, wherein a rear portion of at least one of the handguard rail and the receiver housing defines a slotted octagonal cross-sectional area, wherein the handguard section does not come into physical contact with a barrel or a barrel nut of a firearm, wherein the handguard section extends from the rear portion of the handguard rail to an area over a barrel of the firearm, wherein a combined cross-sectional thickness of the handguard rail and the receiver housing is such that the receiver housing does not protrude through the handguard rail, wherein the combined cross-sectional thickness of the handguard rail and the receiver housing is such that the integral shell deflector of the receiver housing does not protrude away from an exterior surface of the receiver housing, and wherein the handguard rail is mechanically secured to the receiver housing.

12. The combined firearm receiver and rail according to claim 11, wherein the receiver housing further comprises an integral barrel trunnion.

13. The combined firearm receiver and rail according to claim 11 further comprising a dust cover secured to at least one of the handguard rail and the receiver housing.

14. The combined firearm receiver and rail according to claim 11, wherein the mechanical securing is one of a screw, a bolt, a quick detach latch, a clasp, a spring-loaded button, a press-fit, and combinations thereof.

15. The combined firearm receiver and rail according to claim 11, wherein at least one of the handguard rail and the receiver housing are a magnesium material.

16. The combined firearm receiver and rail according to claim 11, wherein at least one of the handguard rail and the receiver housing are a polymeric material.

17. The combined firearm receiver and rail according to claim 11, wherein at least one of the handguard rail and the receiver housing is manufactured by a method selected from the group consisting of extrusion, investment casting, injection molding, machining, and additive manufacturing.

18. The combined firearm receiver and rail according to claim 11, wherein the handguard continuous rail is a continuous picatinny rail.

19. A combined firearm receiver and rail comprising:

a handguard rail; and a receiver housing disposed within the handguard rail, wherein the handguard rail comprises an integral shell deflector and a combined cross-sectional thickness of the handguard rail and the receiver housing is such that the receiver housing does not protrude through the handguard rail.

20. The combined firearm receiver and rail according to claim 19, wherein a combined cross-sectional thickness of the handguard rail and the receiver housing is such that the integral shell deflector of the receiver housing does not protrude away from an exterior surface of the receiver housing.

21. A combined firearm receiver and rail comprising:

a handguard rail;

a receiver housing disposed within the handguard rail, wherein the handguard rail comprises a charging handle guideway, the charging handle guideway extending along an entire length of the handguard rail, and wherein the receiver housing comprises an integral shell deflector, and wherein a combined cross-sectional thickness of the handguard rail and the receiver housing is such that the integral shell deflector of the receiver housing does not protrude away from an exterior surface of the receiver housing.

* * * * *